US006351730B2

(12) United States Patent
Chen

(10) Patent No.: US 6,351,730 B2
(45) **Date of Patent: *Feb. 26, 2002**

(54) LOW-COMPLEXITY, LOW-DELAY, SCALABLE AND EMBEDDED SPEECH AND AUDIO CODING WITH ADAPTIVE FRAME LOSS CONCEALMENT

(75) Inventor: Juin-Hwey Chen, Bell Mead, NJ (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/281,506

(22) Filed: Mar. 30, 1999

Related U.S. Application Data

(60) Provisional application No. 60/080,056, filed on Mar. 30, 1998.

(51) Int. Cl.[7] ..... G10L 19/12

(52) U.S. Cl. ..... 704/229; 704/219; 704/230

(58) Field of Search ..... 704/205, 229, 704/230, 234, 219, 220, 258

(56) References Cited

U.S. PATENT DOCUMENTS

| | | | | | |
|---|---|---|---|---|---|
| 5,105,463 | A | * | 4/1992 | Veldhuis et al. | 704/501 |
| 5,111,417 | A | * | 5/1992 | Belloc et al. | 708/313 |
| 5,457,685 | A | * | 10/1995 | Champion | 370/260 |
| 5,673,363 | A | * | 9/1997 | Jeon et al. | 704/501 |
| 5,819,212 | A | * | 10/1998 | Matsumoto et al. | 704/219 |
| 6,092,041 | A | * | 7/2000 | Pan et al. | 704/229 |

* cited by examiner

*Primary Examiner*—Richemond Dorvil
*Assistant Examiner*—Daniel Abebe

(57) ABSTRACT

High-quality, low-complexity and low-delay scalable and embedded system and method are disclosed for coding speech and general audio signals. The invention is particularly suitable in Internet Protocol (IP)-based multimedia communications. Adaptive transform coding, such as a Modified Discrete Cosine Transform, is used, with multiple small-size transforms in a given signal frame to reduce the coding delay and computational complexity. In a preferred embodiment, for a chosen sampling rate of the input signal, one or more output sampling rates may be decoded with varying degrees of complexity. Multiple sampling rates and bit rates are supported due to the scalable and embedded coding approach underlying the present invention. Further, a novel adaptive frame loss concealment approach is used to reduce the distortion caused by packet loss in communications using IP networks.

43 Claims, 4 Drawing Sheets

BLOCK DIAGRAM OF THE BASIC ENCODER

BLOCK DIAGRAM OF THE BASIC ENCODER

BLOCK DIAGRAM OF THE BASIC DECODER

FRAMING SCHEME SHOWING THE LOCATIONS OF MDCT ANALYSIS WINDOWS RELATIVE TO THE CURRENT FRAME IN AN ILLUSTRATIVE EMBODIMENT OF THE PRESENT INVENTION.

DIAGRAM SHOWING FAST MDCT ALGORITHM USING DCT TYPE IV.

A SIMPLE LINEAR WARPING FUNCTION THAT MAPS THE QUANTIZED LOG-GAINS TO TARGET SNRs.

A PIECE-WISE LINEAR WARPING FUNCTION THAT MAPS THE QUANTIZED LOG-GAINS TO TARGET SNRs.

LOW-COMPLEXITY, LOW-DELAY, SCALABLE AND EMBEDDED SPEECH AND AUDIO CODING WITH ADAPTIVE FRAME LOSS CONCEALMENT

This application claims benefit to Provisional No. 60/080,056 filed Mar. 30, 1998.

FIELD OF THE INVENTION

The present invention relates to audio signal processing and is directed more particularly to a system and method for scalable and embedded coding and transmission of speech and audio signals.

BACKGROUND OF THE INVENTION

In conventional telephone services, speech is sampled at 8,000 samples per second (8 kHz), and each speech sample is represented by 8 bits using the ITU-T G.711 Pulse Code Modulation (PCM), resulting in a transmission bit-rate of 64,000 bits/second, or 64 kb/s for each voice conversation channel. The Plain Old Telephone Service (POTS) is built upon the so-called Public Switched Telephone Networks, (PSTN), which are circuit-switched networks designed to route millions of such 64 kb/s speech signals. Since telephone speech is sampled at 8 kHz, theoretically such 64 kb/s speech signal cannot carry any frequency component that is above 4 kHz. In practice, the speech signal is typically band-limited to the frequency range of 300 to 3,400 Hz by the ITU-T P.48 Intermediate Reference System (IRS) filter before its transmission through the PSTN. Such a limited bandwidth of 300 to 3,400 Hz is the main reason why telephone speech sounds thin, unnatural, and less intelligible compared with the full-bandwidth speech as experienced in face-to-face conversation.

In the last several years, there is a tremendous interest in the so-called "IP telephony", i.e., telephone calls transmitted through packet-switched data networks employing the Internet Protocol (IP). Currently, the common approach is to use a speech encoder to compress 8 kHz sampled speech to a low bit rate, package the compressed bit-stream into packets, and then transmit the packets over IP networks. At the receiving end, the compressed bit-stream is extracted from the received packets, and a speech decoder is used to decode the compressed bit-stream back to 8 kHz sampled speech. The term "codec" (coder and decoder) is commonly used to denote the combination of the encoder and the decoder. The current generation of IP telephony products typically use existing speech codecs that were designed to compress 8 kHz telephone speech to very low bit rates. Examples of such codecs include the ITU-T G.723.1 at 6.3 kb/s, G.729 at 8 kb/s, and G.729A at 8 kb/s. All of these codecs have somewhat degraded speech quality when compared with the ITU-T 64 kb/s G.711 PCM and, of course, they all still have the same 300 to 3,400 Hz bandwidth limitation.

In many IP telephony applications, there is plenty of transmission capacity, so there is no need to compress the speech to a very low bit rate. Such applications include "toll bypass" using high-speed optical fiber IP network backbones, and "LAN phones" that connect to and communicate through Local Area Networks such as 100 Mb/s fast ethernets. In many such applications, the transmission bit rate of each channel can be as high as 64 kb/s. Further, it is often desirable to have a sampling rate higher than 8 kHz, so the output quality of the codec can be much higher than POTS quality, and ideally approaches CD quality, for both speech and non-speech signals, such as music. It is also desirable to have a codec complexity as low as possible in order to achieve high port density and low hardware cost per channel. Furthermore, it is desirable to have a coding delay as low as possible, so that users will not experience significant delay in two-way conversations. In addition, depending on applications, sometimes it is necessary to transmit the decoder output through PSTN. Therefore, the decoder output should be easy to down-sample to 8 kHz for transcoding to 8 kHz G.711. Clearly, there is a need to address the requirements presented by these and other applications.

The present invention is designed to meet these and other practical requirements by using an adaptive transform coding approach. Most prior art audio codecs based on adaptive transform coding use a single large transform (1024 to 2048 data points) in each processing frame. In some cases, switching to smaller transform sizes is used, but typically during transient regions of the signal. As known in the art, a large transform size leads to relatively high computational complexity and high coding delay which, as pointed above, are undesirable in many applications. On the other hand, if a single small transform is used in each frame, the complexity and coding delay go down, but the coding efficiency also go down, partially because the transmission of side information (such as quantizer step sizes and adaptive bit allocation) takes a significantly higher percentage of the total bit rate.

By contrast, the present invention uses multiple small-size transforms in each frame to achieve low complexity, low coding delay, and a good compromise in coding efficiently the side information. Many low-complexity techniques are used in accordance with the present invention to ensure that the overall codec complexity is as low as possible. In a preferred embodiment, the transform used is the Modified Discrete Cosine Transform (MDCT), as proposed by Princen et al., Proceedings of 1987 IEEE International Conference in Acoustics, Speech, and Signal Processing, pp. 2161–2164, the content of which is incorporated by reference.

In IP-based voice or audio communications, it is often desirable to support multiple sampling rates and multiple bit rates when different end points have different requirements on sampling rates and bit rates. A conventional (although not so elegant) solution is to use several different codecs, each capable of operating at only a fixed bit-rate and a fixed sampling rate. A serious disadvantage of this approach is that several completely different codecs have to be implemented on the same platform, thus increasing the total storage requirement for storing the programs for all codecs. Furthermore, if the application requires multiple output bit-streams at multiple bit-rates, the system needs to run several different speech codecs in parallel, thus increasing the overall computational complexity.

A solution to this problem in accordance with the present invention is to use scalable and embedded coding. The concept of scalable and embedded coding itself is known in the art. For example, the ITU-T has a G.727 standard, which specifies a scalable and embedded ADPCM codec at 16, 24 and 32 kb/s. Also available is the Philips proposal of a scalable and embedded CELP (Code Excited Linear Prediction) codec architecture for 14 to 24 kb/s [1997 IEEE Speech Coding Workshop]. However, both the ITU-T standard and the Phillips proposal deal with a single fixed sampling rate of 8 kHz. In practical applications this can be a serious limitation.

In particular, due to the large variety of terminal devices and communication links used for IP-based voice communications, it is generally desirable, and sometimes even necessary, to link communication devices with widely different operating characteristics. For example, it may be necessary to provide high-quality, high-bandwidth speech (at sampling rates higher than 8 kHz and bandwidths wider than the typical 3.4 kHz telephone bandwidth) for devices connected to a LAN, and at the same time provide telephone-bandwidth speech over PSTN to remote locations. Such needs may arise, for example, in tele-conferencing applications. Addressing such needs, the present invention is able to handle several sampling rates rather than a single fixed sampling rate. In terms of scalability in sampling rate and bit rate, the present invention is similar to co-pending application Ser. No. 60/059,610 filed Sep. 23, 1997, the content of which is incorporated by reference. However, the actual implementation methods are very different.

It should be noted that although the present invention is described primarily with reference to a scalable and embedded codec for IP-based voice or audio communications, it is by no means limited to such applications, as will be appreciated by those skilled in the art.

SUMMARY OF THE INVENTION

In a preferred embodiment, the system of the present invention is an adaptive transform codec based on the MDCT transform. The codec is characterized by low complexity and low coding delay and as such is particularly suitable for IP-based communications. Specifically, in accordance with a basic-configuration embodiment, the encoder of the present invention takes digitized input speech or general audio signal and divides it into (preferably short-duration) signal frames. For each signal frame, two or more transform computations are performed on overlapping analysis windows. The resulting output is stored in a multi-dimensional coefficient array. Next, the coefficients thus obtained are quantized using a novel processing method, which is based on calculations of the log-gains for different frequency bands. A number of techniques are disclosed to make the quantization as efficient as possible for a low encoder complexity. In particular, a novel adaptive bit-allocation approach is proposed, which is characterized by very low complexity. The stream of quantized transform coefficients and log-gain parameters are finally converted to a bit-stream. In a specific embodiment, a 32 kHz input signal and a 64 kb/s output bit-stream are used.

The decoder implemented in accordance with the present invention, is capable of decoding this bit-stream directly, without the conventional downsampling, into one or more output signals having sampling rate(s) of 32 kHz, 16 kHz, or 8 kHz in this illustrative embodiment. The lower bit-rate output is decoded in a simple and elegant manner, which has low complexity. Further, the decoder features a novel adaptive frame loss concealment processor that reduces the effect of missing or delayed packets on the quality of the output signal.

Importantly, in accordance with the present invention, the proposed system and method can be extended to implementations featuring embedded coding over a set of sampling rates. Embedded coding in the present invention is based on the concept of using a simplified model of the signal with a small number of parameters, and gradually adding to the accuracy of each next stage of bit-rate to achieve a higher and higher fidelity in the reconstructed signal by adding new signal parameters (i.e., different transform coefficients), and/or increasing the accuracy of their representation.

More specifically, a system for processing audio signals is disclosed, comprising: (a) a frame extractor for dividing an input audio signal into a plurality of signal frames corresponding to successive time intervals; (b) a transform processor for performing transform computation of a signal in at least one signal frame, said transform processor generating a transform signal having one or more bands; (c) a quantizer providing an output bit stream corresponding to quantized values of the transform signal in said one or more bands; and (d) a decoder capable of reconstructing from the output bit stream at least two replicas of the input signal, each replica having a different sampling rate. In another embodiment, the system of the present invention further comprises an adaptive bit allocator for determining an optimum bit-allocation for encoding at least one of said one or more bands of the transform signal.

BRIEF DESCRIPTION OF THE DRAWINGS

The present invention will be described with particularity in the following detailed description and the attached drawings, in which.

DETAILED DESCRIPTION OF THE INVENTION

A. The Basic Codec Principles and Architecture

Figure 1:
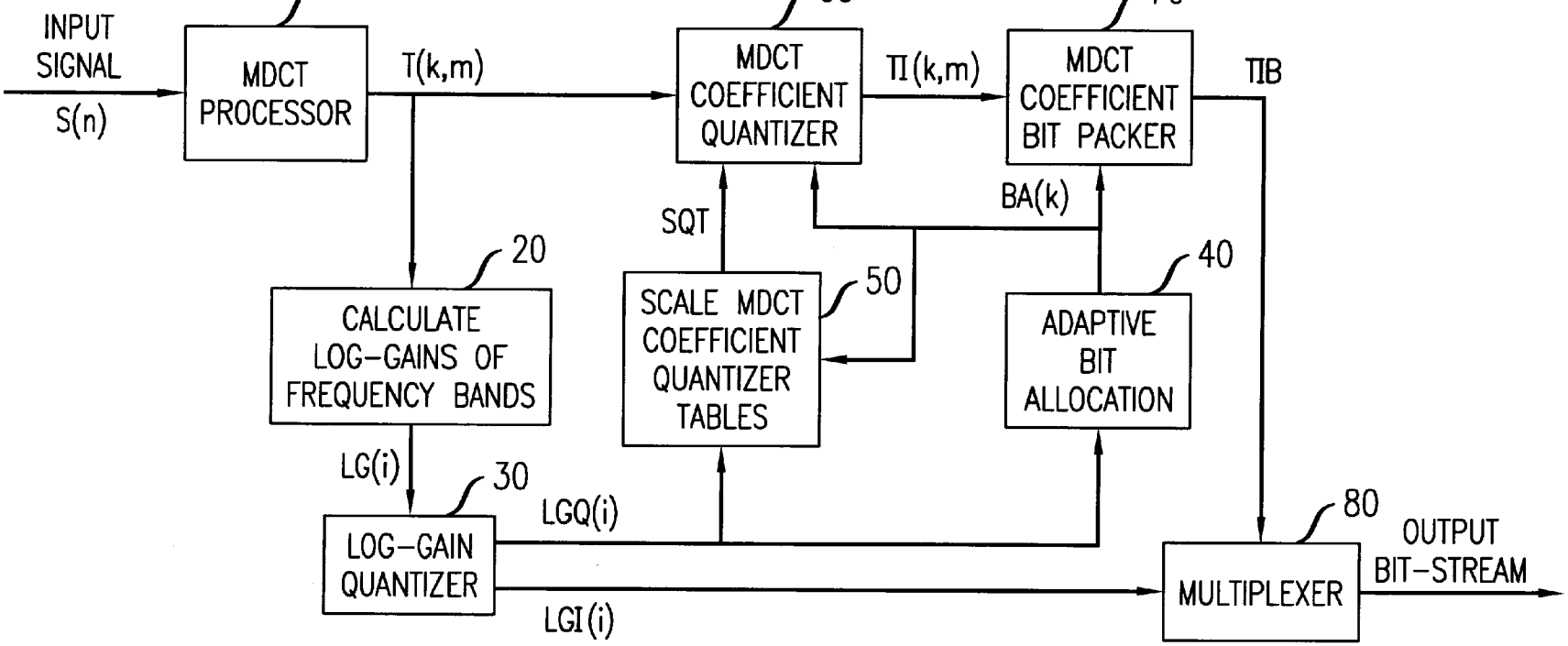
FIG. 1 is a block-diagram of the basic encoder architecture in accordance with a preferred embodiment of the present invention.
Figure 2:
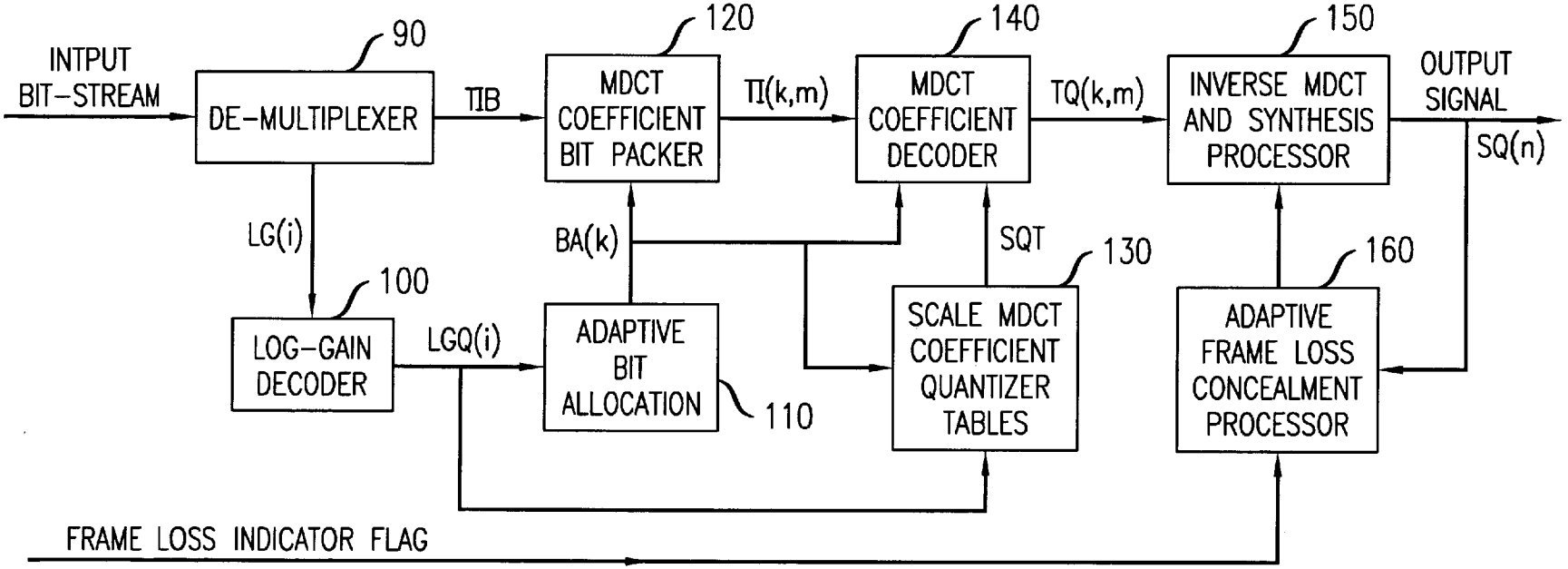
FIG. 2 is a block-diagram of the basic decoder architecture corresponding to the encoder shown in FIG. 1.

The basic codec architecture of the present invention (not showing embedded coding expressly) is shown in FIGS. 1 and 2, where FIG. 1 shows the block diagram of an encoder, while FIG. 2 shows a block diagram of a decoder in an illustrative embodiment of the present invention. It should be emphasized that the present invention is useful for coding either speech or other general audio signals, such as music. Therefore, unless expressly stated otherwise, the following description applies equally to processing of speech or other general audio signals.

A.1 The Method

In one illustrative embodiment of the method of the present invention, with reference to the encoder shown in FIG. 1, the input signal is divided into processing frames, which in a specific low-delay embodiment are 8 ms long. Next, for each frame the encoder performs two or more (8 ms) MDCT transforms (size 256 at 32 kHz sampling rate), with the standard windowing and overlap between adjacent windows. In an illustrative embodiment shown in FIG. 3, a sine-window function with 50% overlap between adjacent windows is used. Further, in a preferred embodiment, the frequency range of 0 to 16 kHz of the input signal is divided non-uniformly into NB bands, with smaller bandwidths in low frequency regions and larger bandwidths in high frequency regions to conform with the sensitivity of the human ear, as can be appreciated by those skilled in the art. In a specific embodiment 23 bands are used.

In the following step, the average power of the MDCT coefficients (of the two transforms) in each frequency band is calculated and converted to a logarithmic scale using base-2 logarithm. Advantages derived from this conversion are described in later sections. The resulting "log-gains" for the NB (e.g. 23) bands are next quantized. In a specific embodiment, the 23 log-gains are quantized using a simple version of adaptive predictive PCM (ADPCM) in order to achieve very low complexity. In another embodiment, these log-gains are transformed using a Karhunen-Loeve transformation (KLT), the resulting KLT coefficients are quantized and transformed back by inverse KLT to obtain quantized log-gains. The method of this second embodiment has higher coding efficiency, while still having relatively low complexity. The reader is directed for more details on KLT to Section 12.5 of the book "Digital Coding of Waveforms" by Jayant and Noll, 1984 Prentice Hall, which is incorporated by reference.

In accordance with the method of the present invention, the quantized log-gains are used to perform adaptive bit allocation, which determines how many bits should be used to quantize the MDCT coefficients in each of the NB frequency bands. Since the decoder can perform the same adaptive bit allocation based on the quantized log-gains, in accordance with the present invention advantageously there is no need for the encoder to transmit separate bit allocation information. Next, the quantized log-gains are converted back to the linear domain and used in a specific embodiment to scale the MDCT coefficient quantizer tables. The MDCT coefficients are then quantized to the number of bits, as determined by adaptive bit allocation using, for example, a Lloyd-Max scalar quantizers. These quantizers are known in the art, so further description is not necessary. The interested reader is directed to Section 4.4.1 of Jayant and Noll's book, which is incorprated herein by reference.

In accordance with the present invention, the decoder reverses the operations performed at the encoder end to obtain the quantized MDCT coefficients and then perform the well-known MDCT overlap-add synthesis to generate the decoded output waveform.

In a preferred embodiment of the present invention, a novel low-complexity approach is used to perform adaptive bit allocation at the encoder end. Specifically, with reference to the basic-architecture embodiment discussed above, the quantized log-gains of the NB (e.g., 23) frequency bands represent an intensity scale of the spectral envelope of the input signal. The N log-gains are first "warped" from such an intensity scale to a "target signal-to-noise ratio" (TSNR) scale using a warping curve. In accordance with the present invention, a line, a piece-wise linear curve or a general-type warping curve can be used in this mapping. The resulting TSNR values are then used to perform adaptive bit allocation.

In one illustrative embodiment of the bit-allocation method of the present invention, the frequency band with the largest TSNR value is given one bit for each MDCT coefficient in that band, and the TSNR of that band is reduced by a suitable amount. After such an update, the frequency band containing the largest TSNR value is identified again and each MDCT coefficient in that band is given one more bit, and the TSNR of that band is reduced by a suitable amount. This process continues until all available bits are exhausted.

In another embodiment, which results in an even lower complexity, the TSNR values are used by a formula to directly compute the number of bits assigned to each of the N transform coefficients. In a preferred embodiment, the bit assignment is done using the formula:

$$R_k = R + \frac{1}{2}\log_2 \frac{\sigma_k^2}{\left[\prod_{j=0}^{N-1} \sigma_j^2\right]^{1/N}}$$

where R is the average bit rate, N is the number of transform coefficients, $R_k$ is the bit rate for the k-th transform coefficient, and $\sigma_k^2$ is the variance of the k-th transform coefficient. Notably, the method used in the present invention does not require the iterative procedure used in the prior art for the computation of this bit allocation.

Another aspect of the method of the present invention is decoding the output signal at different sampling rates. In a specific implementation, e.g., 32, 16, or 8 kHz sampling rates are used, with very simple operations. In particular, in a preferred embodiment of the present invention to decode the output at (e.g., 16 or 8 kHz) sampling rates, the decoder of the system simply has to scale the first half or first quarter of the MDCT coefficients computed at the encoder, respectively, with an appropriately chosen scaling factor, and then apply half-length or quarter-length inverse MDCT transform and overlap-add synthesis. It will be appreciated by those skilled in the art that the decoding complexity goes down as the sampling rate of the output signal goes down.

Another aspect of the preferred embodiment of the method of the present invention is a low-complexity way to perform adaptive frame loss concealment. This method is equally applicable to all three output sampling rates, which are used in the illustrative embodiment discussed above. In particular, when a frame is lost due to a packet loss, the decoded speech waveform in previous good frames (regardless of its sampling rate) is down-sampled to 4 kHz. A computationally efficient method then uses both the previously decoded waveform and the 4 kHz down-sampled version to identify an optimal time lag to repeat the previously decoded waveform to fill in the gap created by the frame loss in the current frame. This waveform extrapolation method is then combined with the normal MDCT overlap-add synthesis to eliminate possible waveform discontinuities at the frame boundaries and to minimize the duration of the waveform gap that the waveform extrapolation has to fill in.

Importantly, in another aspect the method of the present invention is characterized by the capability to provide scalable and embedded coding. Due to the fact that the decoder of the present invention can easily decode transmitted MDCT coefficients to 32, 16, or 8 kHz output, the codec lends itself easily to a scalable and embedded coding paradigm, discussed in Section D. below. In an illustrative embodiment, the encoder can spend the first 32 kb/s exclusively on quantizing those log-gains and MDCT coefficients in the 0 to 4 kHz frequency range (corresponding to an 8 kHz codec). It can then spend the next 16 kb/s on quantizing those log-gains and MDCT coefficients either exclusively in the 4 to 8 kHz range, or more optimally, in the entire 0 to 8 kHz range if the signal can be coded better that way. This corresponds to a 48 kb/s, 16 kHz codec, with a 32 kb/s, 8 kHz codec embedded in it. Finally, the encoder can spend another 16 kb/s on quantizing those log-gains and MDCT coefficients either exclusively in the 8 to 16 kHz range or in the entire 0 to 16 kHz range. This will create a 64 kb/s, 32 kHz codec with the previous two lower sampling-rate and lower bit-rate codecs embedded in it.

In an alternative embodiment, it is also possible to have another level of embedded coding by having a 16 kb/s, 8 kHz codec embedded in the 32 kb/s, 8 kHz codec so that the overall scalable codec offers a lowest bit rate of 16 kb/s for a somewhat lesser-quality output than the 32 kb/s, 8 kHz codec. Various features and aspects of the method of the present invention are described in further detail in sections B., C., and D. below.

B. The Encoder Structure and Operation

FIG. 1 is a block-diagram of the basic architecture for an encoder used in a preferred embodiment of the present invention. The individual blocks of the encoder and their operation, as shown in FIG. 1, are considered in detail next.

B.1 The Modified Discrete Cosine Transform (MDCT) Processor

Figure 3:
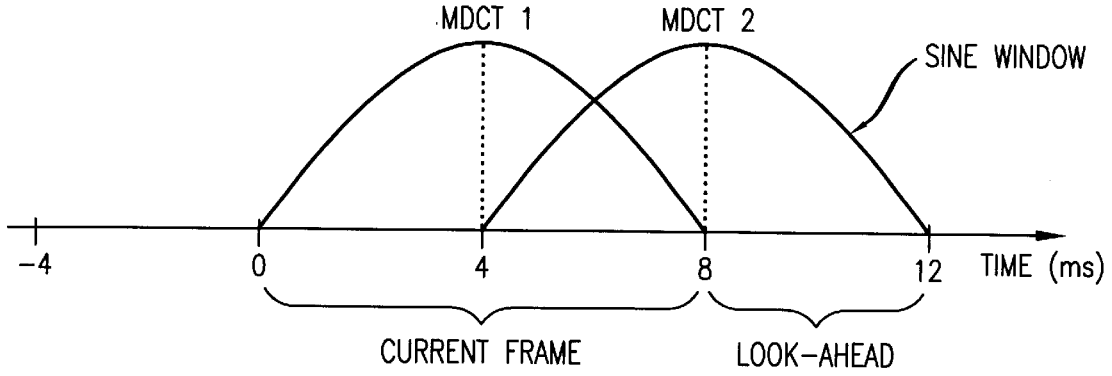
FIG. 3 is a framing scheme showing the locations of analysis windows relative to the current frame in an illustrative embodiment of the present invention.

With reference to FIG. 1, the input signal s(n), which in a specific illustrative embodiment is sampled at 32 kHz, is buffered and transformed into MDCT coefficients by the MDCT processor 10. FIG. 3 shows the framing scheme used by processor 10 in an illustrative embodiment of the present invention, where two MDCT transforms are taken in each processing frame. Without loss of generality and for purposes of illustration, in FIG. 3 and the description below it is assumed that the input-signal is sampled at 32 kHz, and that each frame covers 8 ms (milliseconds). It will be appreciated that other sampling rates and frame sizes can be used in alternative embodiments implemented in accordance with the present invention.

With reference to FIG. 3, the input signal from 0 ms to 8 ms is first windowed by a sine window, and the windowed signal is transformed to the frequency domain by MDCT, as described below. Next, the input signal from 4 ms to 12 ms is windowed by the second sine window shown in FIG. 3, and the windowed signal is again transformed by MDCT processor 10. Thus, for each 8 ms frame, in the embodiment shown in FIG. 3, there are two sets of MDCT coefficients corresponding to two signal segments, which are overlapped by 50%.

As shown in FIG. 3, in this embodiment the frame size is 8 ms, and the look-ahead is 4 ms. The total algorithmic buffering delay is therefore 12 ms. In accordance with alternative embodiments of the present invention, if the acceptable coding delay for the application is not that low, then 3, 4, or 5 MDCT transforms can be used in each frame, corresponding to a frame size of 12, 16, or 20, respectively. Larger frame sizes with a correspondingly larger number of MDCT transforms can also be used. It should also be appreciated that the specific frame size of 8 ms discussed herein is just an example, which is selected for illustration in applications requiring very low coding delay.

With reference to FIG. 3, at a sampling rate of 32 kHz, there are 32 samples for each millisecond. Hence, with an 8 ms sine window, the length of the window is 32×8=256 samples. After the MDCT transform, theoretically there are 256 MDCT coefficients, each of which is a real number. However, the second half of the coefficients are just an anti-symmetric mirror image of the first half. Thus, there are only 128 independent coefficients covering the frequency range of 0 to 16,000 Hz, where each MDCT coefficient corresponds to a bandwidth of 16,000/128=125 Hz.

Figure 4:
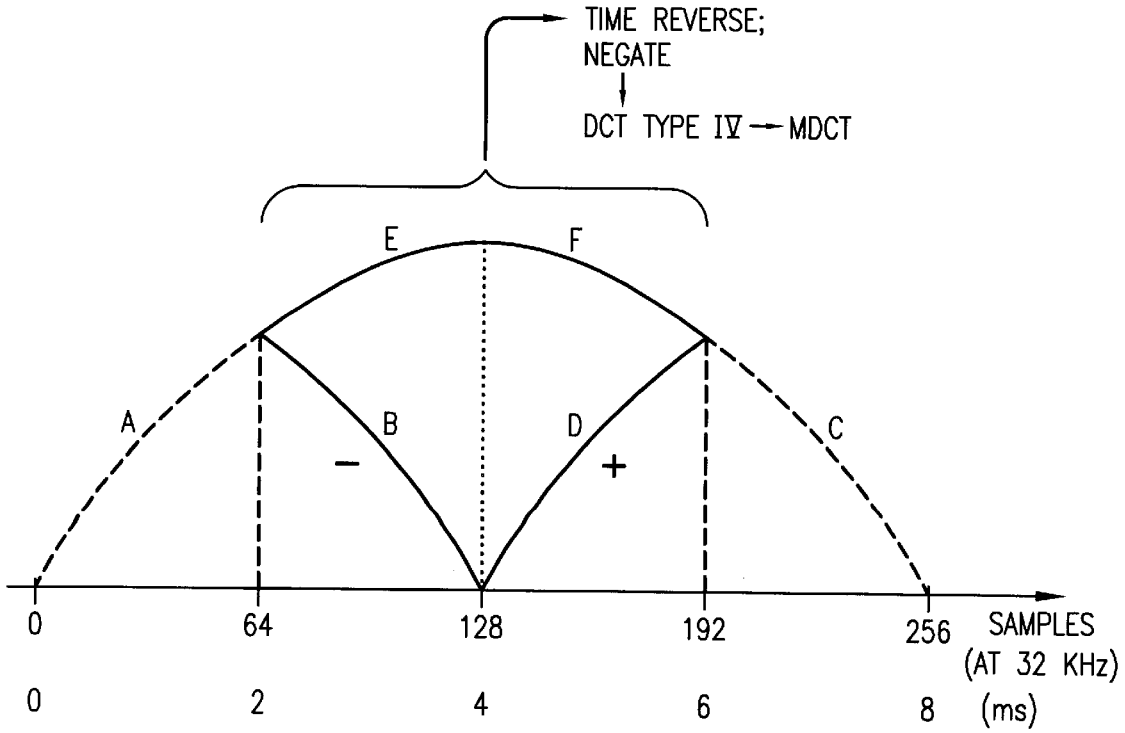
FIG. 4 illustrates a fast MDCT algorithm using DCT type IV computation, used in accordance with a preferred embodiment of the present invention.

It is well-known in the art that these 128 MDCT coefficients can be computed very efficiently using Discrete Cosine Transform (DCT) type IV. For example, see Sections 2.5.4 and 5.4.1 of the book "Signal Processing with Lapped Transforms" by H. S. Malvar, 1992, Artech House, which sections are incorporated by reference. This efficient method is illustrated in FIG. 4. With reference to FIG. 4, the sections designated A, E, F, and C together represent the input signal windowed by a sine window. In the fast algorithm, section A of the windowed signal from sample index 0 to sample index 63 is mapped to section B (from index 64 to 127) by mirror imaging, and then section B is subtracted from section E. Similarly, section C is mirror-imaged to section D, which is then added to section F. The resulting signal is from sample index 64 to 191, and has a total length of 128. This signal is then reversed in order and negated, as known in the art, and the DCT type IV transform of this 128-sample signal gives the desired 128 MDCT coefficients.

Referring back to FIG. 1, for each frame, MDCT processor 10 generates a two-dimensional output MDCT transform coefficient array defined as:

$$T(k,m), k=0,1,2,\ldots,M-1, \text{ and } m=0,1,\ldots,NTPF-1,$$

where M is the number of MDCT coefficients in each MDCT transform, and NTPF is the number of transforms per frame. As known in the art, the DCT type IV transform computation is given by $$X_k = \sqrt{\frac{2}{M}} \sum_{n=0}^{M-1} x_n \cos\left[\left(n+\frac{1}{2}\right)\left(k+\frac{1}{2}\right)\frac{\pi}{M}\right]$$

where $x_n$ is the time domain signal, $X_k$ is the DCT type IV transform of $x_n$, and M is the transform size, which is 128 in the 32 kHz example discussed herein. In the illustrative example shown in FIG. 3, M=128, and NTPF=2.

B.2 Calculation and Quantization of Logarithmic Gains

Referring back to FIG. 1, in a preferred embodiment of the present invention, processor 20 calculates the base-2 logarithm of the average power (the "log-gain") of the MDCT coefficients T(k,m) in each of NB frequency bands, where in a specific embodiment NB=23. To exploit the properties of human auditory system, larger bandwidths are used for higher frequency bands. Thus, in a preferred embodiment, the boundaries for the NB bands are stored in an array BI(i), i=0, 1, . . . , 23, which contains the MDCT indices corresponding to the frequency band boundaries, and is given by $$BI=[0,2,4,6,8,10,12,14,16,18,21,24,28,32,37,43,49,56,64,73,83,95,109,124],$$

Accordingly, the bandwidth of the i-th frequency band, in terms of number of MDCT coefficients, is $$BW(i)=BI(i+1)-BI(i).$$

In a preferred embodiment, the NB (i.e., 23) log-gains are calculated as $$LG(i) = \log_2\left(\frac{1}{NTPF \times BW(i)} \sum_{m=0}^{NTPF-1} \sum_{k=BI(i)}^{BI(i+1)-1} T^2(k,m)\right),$$

$$i = 0, 1, 2, \ldots, NB-1$$

In a preferred embodiment, the last four MDCT coefficients (k=124, 125, 126, and 127) are discarded and not coded for transmission at all. This is because the frequency range these coefficients represent, namely, from 15,500 Hz to 16,000 Hz, is typically attenuated by the anti-aliasing filter in the sampling process. Therefore, it is undesirable that the corresponding, possibly greatly attenuated power values, bias the log-gain estimate of the last frequency band.

With reference to FIG. 1, the log-gain quantizer 30 quantizes the NB (e.g., 23) log-gains LG(i), i=0, 1, . . . , 22 and produces two output arrays. The first array LGQ(i), i=0, 1, . . . , 22 contains the quantized log-gains, which is the quantized version of LG(i), i=0, 1, . . . , 22. The second array LGI(i), i=0, 1, . . . , 22 contains the quantizer output indices that can be used to do table look-up decoding of the LGQ array, as discussed in more detail below.

In an illustrative embodiment of the present invention, the log-gain quantizer 30 uses a very simple ADPCM predictive coding scheme in order to achieve a very low complexity. In particular, the first log-gain LG(0) is directly quantized by a 6-bit Lloyd-Max optimal scalar quantizer trained on LG(0) values obtained in a training database. This results in the quantized version LGQ(0) and the corresponding quantizer output index of LGI(0). In a specific embodiment, the remaining log-gains are quantized in sequence from the second to the 23rd log-gain, using simple differential coding. In particular, from the second log-gain on, the difference between the i-th log-gain LG(i) and the (i−1)-th quantized log-gain LGQ(i−1), which is given by the expression $$DLG(i)=LG(i)-LGQ(\mathrm{i}-1)$$

is quantized in a specific embodiment by a 5-bit Lloyd-Max scalar quantizer, which is trained on DLG(i), i=1, 2, . . . , 22 collected from a training database. The corresponding quantizer output index is LGI(i). If DLGQ(i) is the quantized version of DLG(i), then the i-th quantized log-gain is obtained as $$LGQ(i)=DLGQ(i)+LGQ(i-1).$$

With this simple scheme, a total of 6+5×22=116 bits per frame are used to quantize the log-gains of 23 frequency bands used in the illustrative embodiment.

If it is desirable to achieve the same quantization accuracy with fewer bits, at the cost of slightly higher complexity, in accordance with an alternative embodiment of the present invention, a KLT transform coding method is used. The reader is referred to Section 12.5 Jayant and Noll's, for further detail on the KLT transform. In this embodiment, the 23 KLT basis vectors, each being 23 dimensional, is designed off-line using the 23-dimensional log-gain vectors (LG(i), i=0, 1, . . . , 22 for all frames) collected from a training database. Then, in actual encoding, the KLT of the LG vector is computed first (i.e., multiply the 23×23 KLT matrix by the 23×1 LG vector). The resulting KLT coefficients are then quantized using either a fixed bit allocation determined off-line based on statistics collected from a training database, or an adaptive bit allocation based on the energy distribution of the KLT coefficients in the current frame. The quantized log-gains LGQ(i), i=0, 1, . . . , 22, are then obtained by multiplying the inverse KLT matrix by the quantized KLT coefficient vector, as people skilled in the art will appreciate.

B.3 Adaptive Bit Allocation

Referring back to FIG. 1, in a preferred embodiment the adaptive bit allocation block 40 of the encoder uses the quantized log-gains LGQ(i), i=0, 1, . . . , 22 obtained in block 30 to determine how many bits should be allocated to the quantization of MDCT coefficients in each of the 23 frequency bands. In a preferred embodiment, the maximum number of bits used to quantize any MDCT coefficient is six; the minimum number of bits is zero. To keep the complexity of this embodiment low, scalar quantization is used. For a bit-rate of 64 kb/s and a frame size of 8 ms, there are 512 bits per frame. If the simple ADPCM scheme described above is used to quantize the 23 log-gains, then such side information takes 116 bits per frame. The remaining bits for main information (MDCT coefficients) is 512−116=396 bits per frame. Again, to keep the complexity low, no attempt is made to allocate different number of bits to the multiple MDCT transforms in each frame. Therefore, for each of the two MDCT transforms used in the illustrative embodiment, block 40 needs to assign 396÷2=198 bits to the 23 frequency bands.

Figure 5:
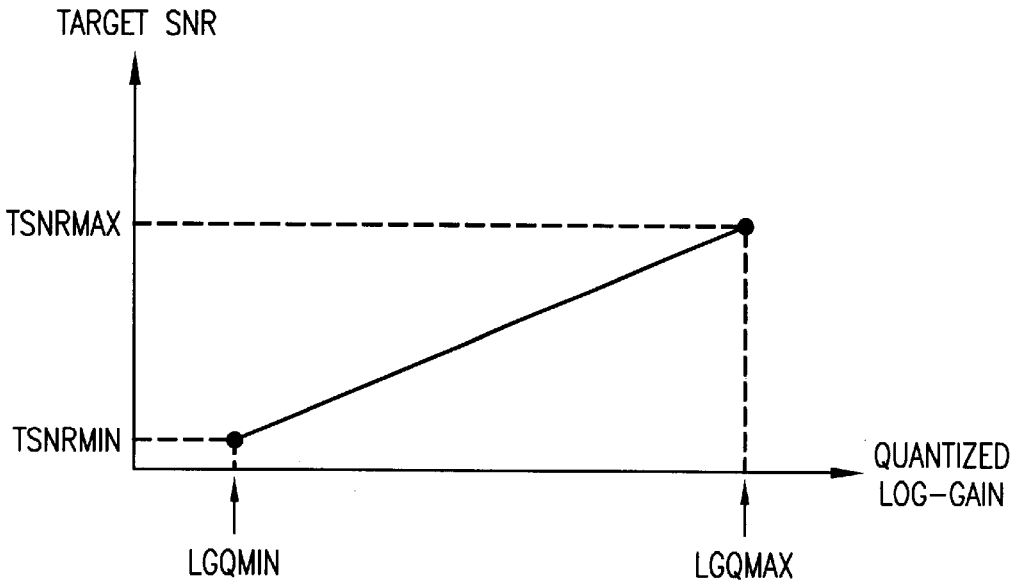
FIG. 5 illustrates a warping function used in a specific embodiment of the present invention for optimized bit allocation.
Figure 6:
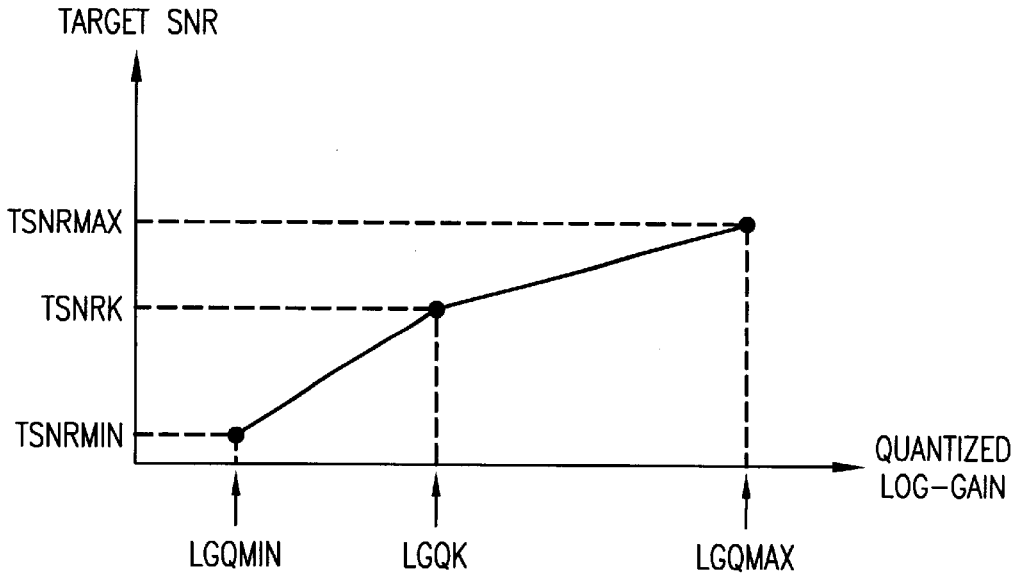
FIG. 6 illustrates another embodiment of the present invention using a piece-wise linear warping function, which allows additional design flexibility for a relatively low complexity.

In a preferred embodiment of the present invention, the first step in adaptive bit allocation performed in block 40 is to map (or "warp") the quantized log-gains to target signal-to-noise ratios (TSNR) in the base-2 log domain. FIGS. 5 and 6 show two illustrative warping functions of such a mapping, used in specific embodiments of the present invention. In each figure, the horizontal axis is the quantized log-gain, and the vertical axis is the target SNR. For each frame, block 40 searches the 23 quantized log-gains LGQ(i), i=0, 1, . . . , 22 to find the maximum quantized log-gain, LGQMAX, and the minimum quantized log-gain, LGQMIN. As shown in FIGS. 5 and 6, LGQMAX is mapped to TSNRMAX, and LGQMIN is mapped to TSNRMIN. All the other quantized log-gain values between LGQMAX and LGQMIN are mapped to target SNR values between TSNRMAX and TSNRMIN.

FIG. 5 shows the simplest possible warping function for the mapping—a straight line. FIG. 6 shows a piece-wise linear warping function consisting of two segments of straight lines. The coordinates of the "knee" of the curve, namely, LGQK and TSNRK, are design parameters that allow different spectral intensity levels in the signal to be emphasized differently during adaptive bit allocation, in accordance with the present invention. As shown in FIG. 6, an illustrative embodiment of the current invention may set LGQK at 40% of the LGQ dynamic range and TSNRK at 2/3 of the TSNR range. That is, $$LGQK=LGQMIN+(LGQMAX-LGQMIN)\times 40\%$$

and $$TSNRK=TSNRMIN+(TSNRMAX-TSNRMIN)\times 2/3$$

Such choices cause those frequency bands in the top 60% of the LGQ dynamic range to be assigned more bits than it would have been otherwise if the warping function of FIG. 5 were used. Thus, the piece-wise linear warping function in FIG. 6 allows more design flexibility, while still keeping the complexity of the encoder low. It will be appreciated that by a simple extension of the approach illustrated in FIG. 6, a piece-wise linear warping function with more than two segments can be used in alternative embodiments.

Focusing next on the operation of block 40, it is first noted that for high-resolution quantization, each additional bit of resolution increases the signal-to-noise ratio (SNR) by about 6 dB (for low-resolution quantization this rule does not necessarily hold true). For simplicity, the rule of 6 dB per bit is assumed below. Since the possible number of bits that each MDCT coefficient may be allocated ranges between 0 to 6, in a specific embodiment of the present invention TSNRMIN is chosen to be 0 and TSNRMAX is chosen to be 12 in the base-2 log domain, which is equivalent to 36 dB. Thus, for each frame the 23 quantized log-gains LGQ(i), i=0, 1, . . . , 22 are mapped to 23 corresponding target SNR values, which range from 0 to 12 in base-2 log domain (equivalent to 0 to 36 dB).

In one illustrative embodiment of the present invention, the adaptive bit allocation block 40 uses the 23 TSNR values to allocate bits to the 23 frequency bands using the following method. First, the frequency band that has the largest TSNR value is found, and assigned one bit to each of the MDCT coefficients in that band. Then, the TSNR value of that band (in base-2 log domain) is reduced by 2 (i.e., by 6 dB). With the updated TSNR values, the frequency band with the largest TSNR value is again identified, and one more bit is assigned to each MDCT coefficient in that band (which may be different from the band in the last step), and the corresponding TSNR value is reduced by 2. This process is repeated until all 198 bits are exhausted. If in the last step of this bit assignment procedure there are X bits left, but there are more than X MDCT coefficients in that winning band, then lower-frequency MDCT coefficients are given priority. That is, each of the X lowest-frequency MDCT coefficients in that band are assigned one more bit, and the remaining MDCT coefficients in that band are not assigned any more bits. Note again that in a preferred embodiment the bit allocation is restricted to the first 124 MDCT coefficients. The last four MDCT coefficients in this embodiment, which correspond to the frequency range from 15,500 Hz to 16,000 Hz, are not quantized and are set to zero.

Another different but computationally more efficient bit allocation method is used in the preferred embodiment of the present invention. This method is based on the expression $$R_k = R + \frac{1}{2}\log_2 \frac{\sigma_k^2}{\left[\prod_{j=0}^{N-1} \sigma_j^2\right]^{1/N}}$$

where $R_k$ is the bit rate (in bits/sample) assigned to the k-th transform coefficient, R is the average bit rate of all transform coefficients, N is the number of transform coefficients, and $\sigma_j^2$ is the square of the standard deviation of the j-th transform coefficient. This formula, which is discussed in Section 12.4 of the Jayant and Noll book, (also incorporated by reference) is the theoretically optimal bit allocation assuming there are no constraints on $R_k$ being a non-negative integer. By taking the base-2 log of the quotient on the right-hand side of the equation, we get $$R_k = R + \frac{1}{2}\left(\log_2\sigma_k^2 - \frac{1}{N}\sum_{j=0}^{N-1}\log_2\sigma_j^2\right)$$

Note that $\log_2 \sigma_k^2$ is simply the base-2 log-gain in the preferred embodiment of the current invention. To use the last equation to do adaptive bit allocation, one simply has to assign the quantized log-gains to the first 124 MDCT coefficients before applying that equation. Specifically, for i=0, 1, . . . , NB−1, let $$lg(k)=LGQ(i), \text{ for } k=BI(i),BI(i)+1, \ldots, BI(i+1)-1.$$

Then, the bit allocation formula becomes $$R_k = R + \frac{1}{2}\left(lg(k) - \frac{1}{BI(NB)}\sum_{j=0}^{BI(NB)-1} lg(j)\right), \text{ or}$$

$$R_k = R + \frac{1}{2}\left[lg(k) - \overline{lg}\right],$$

where $$\overline{lg} = \frac{1}{BI(NB)}\sum_{i=0}^{NB-1}[BI(i+1) - BI(i)]LGQ(i),$$

is the average quantized log-gain (averaged over all 124 MDCT coefficients). Since lg(k) is identical for all MDCT coefficients in the same frequency band, the resulting $R_k$ will also be identical in the same band. Therefore, there are only 23 distinct $R_k$ values. The choice of base-2 logarithm in accordance with the present invention makes the bit allocation formula above very simple. This is the reason why the log-gains computed in accordance with the present invention are represented in the base-2 log domain.

It should be noted that in general $R_k$ is not an integer and can even be negative, while the desired bit allocation should naturally involve non-negative integers. A simple way to overcome this problem is to use the following approach: starting from the lowest frequency band (i=0), round off $R_k$ to the nearest non-negative integer; assign the resulting number of bits to each MDCT coefficient in this band; update the total number of bits already assigned; and continue to the next higher frequency band. This process is repeated until all 198 bits are exhausted. Similar to the approach described above, in a preferred embodiment, in the last frequency band to receive any bits not all MDCT coefficients may receive bits, or alternatively some coefficients may receive higher number of bits than others. Again, lower frequency MDCT coefficients have priority.

In accordance with another specific embodiment, the rounding of $R_k$ can also be done at a slightly higher resolution, as illustrated in the following example for one of the frequency bands. Suppose in a particular band there are three MDCT coefficients, and the $R_k$ for that band is 4.60. Rather than rounding it off to 5 and assigning all three MDCT coefficients 5 bits each, in this embodiment 5 bits could be assigned to each of the first two MDCT coefficients and 4 bit to the last (highest-frequency) MDCT coefficient in that band. This gives an average bit rate of 4.67 bits/sample in that band, which is closer to 4.60 than the 5.0 bits/sample bit rate that would have resulted had we used the earlier approach. It should be apparent that this higher-resolution rounding approach should work better than the simple rounding approach described above, in part because it allows more higher-frequency MDCT coefficients to receive bits when $R_k$ values are rounded up for too many lower-frequency coefficients. Further, this approach also avoids the occasional inefficient situation when the total number of bits assigned is less than the available number of 198 bits, due to too many $R_k$ values being rounded down.

The adaptive bit allocation approaches described above are designed for applications in which low complexity is the main goal. In accordance with an alternative embodiment, the coding efficiency can be improved, at the cost of slightly increased complexity, by more effectively exploiting the noise masking effect of human auditory system. Specifically, one can use the 23 quantized log-gains to construct a rough approximation of the signal spectral envelope. Based on this, a noise masking threshold function can be estimated, as is well-known in the art. After that, the signal-to-masking-threshold-ratio (SMR) values for the 23 frequency bands can be mapped to 23 target SNR values, and one of the bit allocation schemes described above can then be used to assign the bits based on the target SNR values. With the additional complexity of estimating the noise masking threshold and mapping SMR to TSNR, this approach gives better perceptual quality at the codec output.

Regardless of the particular approach which is used, in accordance with the present invention the adaptive bit allocation block 40 generates an output array BA(k), k=0, 1, 2, . . . , 124 as the output, where BA(k) is the number of bits to be used to quantize the k-th MDCT coefficient. As noted above, in a preferred embodiment the potential values of BA(k) are: 0, 1, 2, 3, 4, 5, and 6.

B.4 MDCT Coefficient Quantization

With reference to FIG. 1, functional blocks 50 and 60 work together to quantize the MDCT coefficients, so they are discussed together.

Block 50 first converts the quantized log-gains into the linear-gain domain. Normally the conversion involves evaluating an exponential function:

$$g(i)=2^{LGQ(i)/2}$$

The term g(i) is the quantized version of the root-mean-square (RMS) value in the linear domain for the MDCT coefficients in the i-th frequency band. For convenience, it is referred to as the quantized linear gain, or simply linear gain. The division of LGQ(i) by 2 in the exponential is equivalent to taking square root, which is necessary to convert from the average power to the RMS value.

Assume the log-gains are quantized using the simple ADPCM method described above. Then, to save computation, in accordance with a preferred embodiment, the calculation of the exponential function above can be avoided completely using the following method. Recall that LG(0) is quantized to 6 bits, so there are only 64 possible output values of LGQ(0). For each of these 64 possible LGQ(0) values, the corresponding 64 possible g(0) can be pre-computed off-line and stored in a table, in the same order as the 6-bit quantizer codebook table for LG(0). After LG(0) is quantized to LGQ(0) with a corresponding log-gain quantizer index of LGI(0), this same index LGI(0) is used as the address to the g(0) table to extract the g(0) table entry corresponding to the quantizer output LGQ(0). Thus, the exponential function evaluation for the first frequency band is easily avoided.

From the second band on, we use that $$g(i)=2^{LGQ(i)/2}=2^{1/2[DLGQ(i)+LGQ(i-1)]}=2^{LGQ(i-1)/2}\times 2^{DLGQ(i)/2}=g(i-1)\times 2^{DLGQ(i)/2}$$

Since DLGQ(i) is quantized to 5 bits, there are only 32 possible output values of DLGQ(i) in the quantizer codebook table for quantizing DLGQ(i). Hence, there are only 32 possible values of $2^{DLGQ(i)/2}$, which again can be pre-computed and stored in the same order as the 5-bit quantizer codebook table for DLGQ(i), and can be extracted the same way using the quantizer output index LGI(i) for i=1, 2, . . . , 22. Therefore, g(1), g(2), . . . , g(22), the quantized linear gains for the second band through the 23rd band, can be decoded recursively using the formula above with the complexity of only one multiplication per linear gain, without any exponential function evaluation.

In a specific embodiment, for each of the six non-zero bit allocation results, a dedicated Lloyd-Max optimal scalar quantizer is designed off-line using a large training database. To lower the quantizer codebook search complexity, sign magnitude decomposition is used in a preferred embodiment and only magnitude codebooks are designed. The MDCT coefficients obtained from the training database are first normalized by the respective quantized linear gain g(i) of the frequency bands they are in, then the magnitude (absolute value) is taken. The magnitudes of the normalized MDCT coefficients are then used in the Lloyd-Max iterative design algorithm to design the 6 scalar quantizers (from 1-bit to 6-bit quantizers). Thus, for the 1-bit quantizer, the two possible quantizer output levels have the same magnitude but with different signs. For the 6-bit quantizer, for example, only a 5-bit magnitude codebook of 32 entries is designed. Adding a sign bit makes a mirror image of the 32 positive levels and gives a total of 64 output levels.

With the six scalar quantizers designed this way, in a specific embodiment which uses a conventional quantization method in the actual encoding, each MDCT coefficient is first normalized by the quantized linear gain of the frequency band it is in. The normalized MDCT coefficient is then quantized using the appropriate scalar quantizer, depending on how many bits are assigned to this MDCT coefficient. The decoder will multiply the decoded quantizer output by the quantized linear gain of the frequency band to restore the scale of the MDCT coefficient. At this point it should be noted that although most Digital Signal Processor (DSP) chips can perform a multiplication operation in one instruction cycle, most take 20 to 30 instruction cycles to perform a division operation. Therefore, in a preferred embodiment, to save instructions cycles, the above quantization approach can implement the MDCT normalization by taking the inverse of the quantized linear gain and multiplying the resulting value by each MDCT coefficient in a given frequency band. It can be shown that using this approach, for the i-th frequency band, the overall quantization complexity is 1 division, 4×BW(i) multiplications, plus the codebook search complexity for the scalar quantizer chosen for that band. The multiplication factor of 4 is counting two MDCT coefficients for each frequency (because there are two MDCT transforms per fame), and each need to be multiplied by the gain inverse at the encoder and by the gain at the decoder.

In a preferred embodiment of the codec illustrated in FIGS. 1 and 2, the division operation is avoided. In particular, block 50 scales the selected magnitude codebook once for each frequency band, and then uses the scaled codebook to perform the codebook search. Assuming all MDCT coefficients in a given frequency band are assigned BA(k) bits, then, with both the encoder codebook scaling and decoder codebook scaling counted, the overall quantization complexity of the preferred embodiment is $2\times 2^{BA(k)-1}=2^{BA(k)}$ multiplications plus the codebook search complexity. This can take fewer DSP instruction cycles than the last approach, especially for higher frequency bands where BW(i) is large and BA(k) is typically small. For the lower frequency bands, where BW(i) is small and BA(k) is typically large, the decoder codebook scaling can be avoided and replaced by scaling the selected quantizer output by the linear gain, just like the decoder of the first approach described above. In this case, the total quantization complexity is $2^{BA(k)-1}+2\times BW(i)$ multiplications plus the codebook search complexity.

The codebook search complexity can be substantial especially when BA(k) is large (such as 5 or 6). A third quantization approach in accordance with an alternative embodiment of the present invention is potentially even more efficient overall than the two above, in cases when BA(k) is large.

Note first that the output levels of a Lloyd-Max optimal scalar quantizer are normally spaced non-uniformly. This is why usually a sequential exhaustive search through the whole codebook is done before the nearest-neighbor codebook entry is identified. Although a binary tree search based on quantizer cell boundary values (i.e., mid-points between pairs of adjacent quantizer output levels) can speed up the search, an even faster approach can be used in accordance with the present invention, as described below.

First, given a magnitude codebook, the minimum spacing between any two adjacent magnitude codebook entries is identified (in an off-line design process). Let $\Delta$ be a "step size" which is slightly smaller than the minimum spacing found above. Then, for any of the regions defined by $[\mathrm{Max}(\mathbf{0},\Delta(\mathbf{2}n-1)/2),\Delta(\mathbf{2}n+1)/2)$, n=0, 1, 2, . . . , all points in each region can only be quantized to one of two possible magnitude quantizer output levels which are adjacent to each other. The quantizer indices of these two quantizer output levels, and the mid-point between these two output levels, are pre-computed and stored in a table for each of the integers n=0, 1, 2, . . . (up to the point when $\Delta(\mathbf{2}n+1)/2$ is greater than the maximum magnitude quantizer output level). Let this table be defined as the pre-quantization table. The value $(1/\Delta)$ is calculated and stored for each magnitude codebook. In actual encoding, after a magnitude codebook is chosen for a given frequency band with a quantized linear gain g(i), the stored $(1/\Delta)$ value of that magnitude codebook is divided by g(i) to obtain $1/(g(i)\Delta)$, which is also stored. When quantizing each MDCT coefficient in this frequency band, the MDCT coefficient is first multiplied by this stored value of $1/(g(i)\Delta)$. This is equivalent to dividing the normalized MDCT coefficient by the step size $\Delta$. The resulting value (called $\alpha$), is rounded off to the nearest integer. This integer is used as the address to the pre-quantization table to extract the mid-point value between the two possible magnitude quantizer output levels. One comparison of $\alpha$ with the extracted mid-point value is enough to determine the final magnitude quantizer output level, and thus complete the entire quantization process. Clearly, this search method can be much faster than the sequential exhaustive codebook search or the binary tree codebook search. Assume, for example, that the decoder simply scales the selected quantizer output level by the gain g(i). Then, the overall quantization complexity of this embodiment of the present invention (including the codebook search) for a frequency band with bandwidth BW(i) and BA(k) bits is one division, 4×BW(i) multiplications, 2×BW(i) roundings, and 2×BW(i) comparisons.

It should be noted that which of the three methods is the fastest in a particular implementation depends on many factors: such as the DSP chip used, the bandwidth BW(i), and the number of allocated bits BA(k). To get a fastest code, in a preferred embodiment of the present invention, before quantizing the MDCT coefficient in any given frequency band, one could check BW(i) and BA(k) of that band and switch to the fastest method for that combination of BW(k) and BA(k).

Referring back to FIG. 1, the output of the MDCT coefficient quantizer block 60 is a two-dimensional quantizer output index array TI(k,m), k=0, 1, . . . , BI(NB)−1, and m=0, 1, . . . , NTPF−1.

B.5 Bit Packing and Multiplexing

In accordance with a preferred embodiment, for each frame, the total number of bits for the MDCT coefficients is fixed, but the bit boundaries between MDCT quantizer output indices are not. The MDCT coefficient bit packer 70 packs the output indices of the MDCT coefficient quantizer 60 using the bit allocation information BA(k), k=0, 1, . . . , BI(NB)−1 from adaptive bit allocation block 40. The output of the bit packer 70 is TIB, the transform index bit array, having 396 bits in the illustrative embodiment of this invention.

With reference to FIG. 1, the TIB output is provided to multiplexer 80, which multiplexes the 116 bits of log-gain side information with the 396 bits of TIB array to form the output bit-stream of 512 bits, or 64 bytes, for each frame. The output bit stream may be processed further dependent on the communications network and the requirements of the corresponding transmission protocols.

C. The Decoder Structure and Operation

It can be appreciated that the decoder used in the present invention performs the inverse of the operations done at the encoder end to obtain an output speech or audio signal, which ideally is a delayed version of the input. signal. The decoder used in a basic-architecture codec in accordance with the present invention is shown in a block-diagram form in FIG. 2. The operation of the decoder is described next with reference to the individual blocks in FIG. 2.

C.1 De-Multiplexing and Bit Unpacking

With reference to FIG. 2 and the description of the illustrative embodiment provided in Section B, at the decoder end the input bit stream is provided to de-multiplexer 90, which operates to separate the 116 log-gain side information bits from the remaining 396 bits of TIB array. Before the TIB bit array can be correctly decoded, the MDCT bit allocation information on BA(k), k=0, 1, . . . , BI(NB)−1 needs to be obtained first. To this end, log-gain decoder 100 decodes the 116 log-gain bits into quantized log-gains LGQ(i), i=0, 1, . . . , NB−1 using the log-gain decoding procedures described in Section B.2 above. The adaptive bit allocation block 110 is functionally identical to the corresponding block 40 in the encoder shown in FIG. 1. It takes the quantized log-gains and produces the MDCT bit allocation information BA(k), k=0, 1, . . . , BI(NB)−1. The MDCT coefficient bit unpacker 120 then uses this bit allocation information to interpret the 396 bits in the TIB array and to extract the MDCT quantizer indices TI(km), k=0, 1, . . . , BI(NB)−1, and m=0, 1, . . . , NTPF−1.

C.2 MDCT Coefficient Decoding

The operations of the blocks 130 and 140 are similar to blocks 50 and 60 in the encoder, and have already been discussed in this context. Basically, they use one of several possible ways to decode the MDCT quantizer indices TI(k, m) into the quantized MDCT coefficient array TQ(k,m), k=0, 1, . . . , BI(NB)−1, and m=0, 1, . . . , NTPF−1.

In accordance with the present invention, the MDCT coefficients which are assigned zero bits at the encoder end need special handling. If their decoded values are set to zero, sometimes there is an audible swirling distortion which is due to time-evolving spectral holes. To eliminate such swirling distortion, in a preferred embodiment of the present invention the MDCT coefficient decoder 140 produces non-zero output values in the following way for those MDCT coefficients receiving zero bits.

For each MDCT coefficient which is assigned zero bits, the quantized linear gain of the frequency band that the MDCT coefficient is in is reduced in value by 3 dB (g(i) is multiplied by $1/\sqrt{2}$. The resulting value is used as the magnitude of the output quantized MDCT coefficient. A random sign is used in a preferred embodiment.

C.3 Inverse MDCT Transform and Overlap-Add Synthesis

Referring again to FIG. 2, once the quantized MDCT coefficient array TQ(k,m) is obtained, the inverse MDCT and synthesis processor 150 performs the inverse MDCT transform and the corresponding overlap-add synthesis, as is well-known in the art. Specifically, for each set of 128 quantized MDCT coefficients, the inverse DCT type IV (which is the same a DCT type IV itself) is applied. This transforms the 128 MDCT coefficients to 128 time-domain samples. These time domain samples are time reversed and negated. Then the second half (index 64 to 127) is mirror imaged to the right. The first half (index 0 to 63) is mirror-imaged to the left and then negated (anti-symmetry). Such operations result in a 256-point array. This array is windowed by the sine window. The first half of the array, index 0 to 127 of the windowed array, is then added to the second half of the last windowed array. The result SQ(n) is the overlap-add synthesized output signal of the decoder.

In accordance with a preferred embodiment of the present invention, a novel method is used to easily synthesize a lower sampling rate version at either 16 kHz or 8 kHz having much reduced complexity. Thus, in a specific embodiment, which is relatively inefficient computationally, in order to obtain the 16 kHz output first MDCT coefficients TQ(k,m) for k=64, 65, . . . , 127, are zeroed out. Then, the usual 32 kHz inverse MDCT and overlap-add synthesis are performed, followed by the step of decimating the 32 kHz output samples by a factor of 2. Similarly, to obtain a 8 kHz output, using a similar approach, one could zero out TQ(k, m) for k=32, 33, . . . , 127, perform the 32 kHz inverse transform and synthesis, and then decimate the 32 kHz output samples by a factor of 4. Both approaches work, however, as mentioned above require much more computation than necessary.

Accordingly, in a preferred embodiment of the present invention, a novel low-complexity method is used. Consider the definition of DCT type IV:

$$X_k = \sqrt{\frac{2}{M}} \sum_{n=0}^{M-1} x_n \cos\left[\left(n+\frac{1}{2}\right)\left(k+\frac{1}{2}\right)\frac{\pi}{M}\right]$$

where $x_n$ is the time domain signal, $X_k$ is the DCT type IV transform of $x_n$, and M is the transform size, which is 128 in the 32 kHz example discussed herein. The inverse DCT type IV is given by the expression:

$$x_n = \sqrt{\frac{2}{M}} \sum_{n=0}^{M-1} X_k \cos\left[\left(n+\frac{1}{2}\right)\left(k+\frac{1}{2}\right)\frac{\pi}{M}\right]$$

Taking 8 kHz synthesis for example, since $X_k$=TQ(k,m)=0 for k=32,33, . . . , 127, or k=M/4, M/4+1, . . . , M−1, the computationally inefficient approach mentioned above computes and then decimates the resulting signal $$\tilde{x}_n = \sqrt{\frac{2}{M}} \sum_{n=0}^{\frac{M}{4}-1} X_k \cos\left[\left(n+\frac{1}{2}\right)\left(k+\frac{1}{2}\right)\frac{\pi}{M}\right]$$

by a factor of 4. In accordance with a preferred embodiment of the present invention, a new approach is used, wherein one simply takes a (M/4)-point DCT type IV for the first quarter of the quantized MDCT coefficients, as follows:

$$y_n = \sqrt{\frac{2}{(M/4)}} \sum_{n=0}^{\frac{M}{4}-1} X_k \cos\left[\left(n+\frac{1}{2}\right)\left(k+\frac{1}{2}\right)\frac{\pi}{(M/4)}\right]$$

Rearranging the right-hand side yields $$y_n = 2\left[\sqrt{\frac{2}{M}} \sum_{n=0}^{\frac{M}{4}-1} X_k \cos\left[\left(\left(4n+\frac{3}{2}\right)+\frac{1}{2}\right)\left(k+\frac{1}{2}\right)\frac{\pi}{M}\right]\right] = 2\tilde{x}_{4n+3/2}$$

-continued or $$\tilde{x}_{4n+3/2} = \frac{1}{2} y_n$$

Note from the definition of $\tilde{x}_n$ above, the right-hand side is actually just a weighted sum of cosine functions, and therefore $\tilde{x}_n$ can be viewed as a continuous function of n, where n can be any real number. Hence, although the index 4n+3/2 is not an integer, $\tilde{x}_{4n+3/2}$ is still a valid sample of that continuous function of $\tilde{x}_n$. In fact, with a little further analysis it can be shown that this index of 4n+3/2 is precisely what is needed for the 4:1 decimation to work properly across the "folding", "mirror-imaging" and "unfolding" operations described in Section B.1 above and the first paragraph of this section.

Thus, to synthesize a 8 kHz output, in accordance with a preferred embodiment, the new method is very simple: just extract the first quarter of the MDCT coefficients, take a quarter-length (32-point) inverse DCT type IV, multiply the results by 0.5, then do the same kind of mirror-imaging, sine windowing, and overlap-add synthesis just as described above, except this time the method operates with only a quarter of the number of time domain samples.

Similarly, for a 16 kHz synthesis, in a preferred embodiment the method comprises the steps of: extracting the first half of the MDCT coefficients, taking a half-length (64-point) inverse DCT type IV, multiplying the results by $1/\sqrt{2}$, then doing the same mirror-imaging, sine windowing, and overlap-add synthesis just as described in the first paragraph of this section, except that it is done with only half the number of time domain samples.

Obviously, with smaller inverse DCT type IV transforms and fewer time domain samples to process, the computational complexity of the novel synthesis method used in a preferred embodiment of the present invention for 16 kHz or 8 kHz output is much lower than the first straightforward method described above.

C.4 Adaptive Frame Loss Concealment

As noted above, the encoder system and method of the present invention are advantageously suitable for use in communications via packet-switched networks, such as the Internet. It is well known that one of the problems for such networks, is that some signal frames may be missing, or delivered with such a delay that their use is no longer warranted. To address this problem, in accordance with a preferred embodiment of the present invention, an adaptive frame loss concealment (AFLC) processor 160 is used to perform waveform extrapolation to fill in the missing frames caused by packet loss. In the description below it is assumed that a frame loss indicator flag is produced by an outside source and is made available to the codec.

In accordance with the present invention, when the current frame is not lost, the frame loss indicator flag is not set, and AFLC processor 160 does not do anything except to copy the decoder output signal SQ(n) of the current frame into an AFLC buffer. When the current frame is lost, the frame loss indicator flag is set, the AFLC processor 160 performs analysis on the previously decoded output signal stored in the AFLC buffer to find an optimal time lag which is used to copy a segment of previously decoded signal to the current frame. For convenience of discussion, this time lag is referred to as the "pitch period", even if the waveform is not nearly periodic. For the first 4 ms after the transition from a good frame to a missing frame or from a missing frame to a good frame, the usual overlap-add synthesis is performed in order to minimize possible waveform discontinuities at the frame boundaries.

One way to obtain the desired time lag, which is used in a specific embodiment, is to use the time lag corresponding to the maximum cross-correlation in the buffered signal waveform, treat it as the pitch period, and periodically repeat the previous waveform at that pitch period to fill in the current frame of waveform. This is the essence of the prior art method described by D. Goodman et al., [IEEE Transaction on Acoustics, Speech, and Signal Processing, December 1986].

It has been found that using normalized cross-correlation gives more reliable and better time lag for waveform extrapolation. Still, the biggest problem of both methods is that when it is applied to the 32 kHz waveform, the resulting computational complexity is too high. Therefore, in a preferred embodiment, the following novel method is used with the main goal of achieving the same performance with a much lower complexity using a 4 kHz decimated signal.

Using a decimated signal to lower the complexity of correlation-based pitch estimation is known in the art [see, for example, the SIFT pitch detection algorithm in the book Linear Prediction Of Speech by Markel and Gray]. The preferred embodiment to be described below provides novel improvements specifically designed for concealing frame loss.

Specifically, when the current frame is lost, the AFLC processor 160 implemented in accordance with a preferred embodiment uses a 3rd-order elliptic filter to filter the previously decoded speech in the buffer to limit the frequency content to well below 2 kHz. Next, the output of the filter is decimated by a factor of 8, to 4 kHz. The cross-correlation function of the decimated signal over the target time lag range of 4 to 133 (corresponding to 30 Hz to 1000 Hz pitch frequency) is calculated. The target signal segment to be cross-correlated by delayed segments is the last 8 ms of the decimated signal, which is 32 samples long at 4 kHz. The local cross-correlation peaks that are greater than zero are identified. For each of these peaks, the cross-correlation value is squared, and the result is divided by the product of the energy of the target signal segment and the energy of the delayed signal segment, with the delay being the time lag corresponding to the cross-correlation peak. The result, which is referred to as the likelihood function, is the square of the normalized cross-correlation (which is also the square of the cosine function of the angle between the two signal segment vectors in the 32-dimensional vector space). When the two signal segments have exactly the same shapes, the angle is zero, and the likelihood function will be unity.

Next, in accordance with the present invention, the method finds maximum of such likelihood function values evaluated at the time lags corresponding to the local peaks of the cross-correlation function. Then, a threshold is set by multiplying this maximum value by a coefficient, which in a preferred embodiment is 0.95. The method next finds the smallest time lag whose corresponding likelihood function exceeds this threshold value. In accordance with the preferred embodiment, this time lag is the preliminary pitch period in the decimated domain.

The likelihood functions for 5 time lags around the preliminary pitch period, from two below to two above are then evaluated. A check is then performed to see if one of the middle three lags corresponds to a local maximum of the likelihood function. If so, quadratic interpolation, as is well-known in the art, around that lag is performed on the likelihood function, and the fractional time lag corresponding to the peak of the parabola is used as the new preliminary pitch period. If none of the middle three lag corresponds to a local maximum in the likelihood function, the previous preliminary pitch period is used in the current frame.

The preliminary pitch period is multiplied by the decimation factor of 8 to get the coarse pitch period in the undecimated signal domain. This coarse period is next refined by searching around its neighborhood. Specifically, one can go from half the decimation factor, or 4, below the coarse pitch period, to 4 above. The likelihood function in the undecimated domain, using the undecimated previously decoded signal, is calculated for the 9 candidate time lags. The target signal segment is still the last 8 ms in the AFLC buffer, but this time it is 256 samples at 32 kHz sampling. Again, the likelihood function is the square of the cross-correlation divided by the product of the energy of the target signal segment and the energy of the delayed signal segment, with the candidate time lag being the delay.

The time lag corresponding to the maximum of the 9 likelihood function values is identified as the refined pitch period in accordance with the preferred embodiment of this invention. Sometimes for some very challenging signal segments, the refined pitch period determined this way may still be far from ideal, and the extrapolated signal may have a large discontinuity at the boundary from the last good frame to the first bad frame, and this discontinuity may get repeated if the pitch period is less than 4 ms. Therefore, as a "safety net", after the refined pitch period is determined, in a preferred embodiment, a check for possible waveform discontinuity is made using a discontinuity measure. This discontinuity measure can be the distance between the last sample of the previously decoded signal in the AFLC buffer and the first sample in the extrapolated signal, divided by the average magnitude difference between adjacent samples over the last 40 samples of the AFLC buffer. When this discontinuity measure exceeds a pre-determined threshold of, say, 13, or if there is no positive local peak of cross-correlation of the decimated signal, then the previous search for a pitch period is declared a failure and a completely new search is started; otherwise, the refined pitch period determined above is declared the final pitch period.

The new search uses the decimated signal buffer and attempts to find a time lag that minimizes the discontinuity in the waveform sample values and waveform slope, from the end of the decimated buffer to the beginning of extrapolated version of the decimated signal. In a preferred embodiment, the distortion measure used in the search consists of two components: (1) the absolute value of the difference between the last sample in the decimated buffer and the first sample in the extrapolated decimated waveform using the candidate time lag, and (2) the absolute value of the difference in waveform slope. The target waveform slope is the slope of the line connecting the last sample of the decimated signal buffer and the second-last sample of the same buffer. The candidate slope to be compared with the target slope is the slope of the line connecting the last sample of the decimated signal buffer and the first sample of the extrapolated decimated signal. To accommodate for different scale the second component (the slope component) may be weighted more heavily, for example, by a factor of 3, before combining with the first component to form a composite distortion measure. The distortion measure is calculated for the time lags between 16 (for 4 ms) and the maximum pitch period (133). The time lag corresponding to the minimum distortion is identified and is multiplied by the decimation factor 8 to get the final pitch period.

Once the final pitch period is determined, the AFLC processor first extrapolates 4 ms worth of speech from the beginning of the lost frame, by copying the previously decoded signal that is one pitch period earlier. Then, the inverse MDCT and synthesis processor 150 applies the first half of the sine window and then performs the usual mirror-imaging and subtraction as described in Section B.1 for these 4 ms of windowed signal. Then, the result is treated as if it were the output of the usual inverse DCT type IV transform, and block 150 proceeds as usual to perform overlap-add operation with the second half of the last windowed signal in the previous good frame. These extra steps used in a preferred embodiment of the present invention for handling packet loss, are designed to make full utilization of the partial information about the first 4 ms of the lost frame that is carried in the second MDCT transform of the last good frame. By doing this, the method of this invention ensures that the waveform transition will be smooth in the first 4 ms of the lost frame.

For the second 4 ms (the second half of the lost frame), there is no prior information that can be used, therefore, in a preferred embodiment, one can simply keep extrapolating the final pitch period. Note that in this case if the extrapolation needs to use the signal in the first 4 ms of the lost frame, it should use the 4 ms segment that is newly synthesized by block 150 to avoid any possible waveform discontinuity. For this second 4 ms of waveform, block 150 just passes it straight through to the output.

In a preferred embodiment, the AFLC processor 160 then proceeds to extrapolate 4 ms more waveform into the first half of the next frame. This is necessary in order to prepare the memory of the inverse MDCT overlap-add synthesis. This 4 ms segment of waveform in the first half of the next frame is then processed by block 150, where it is first windowed by the second half of the sine window, then "folded" and added, as described in Section B.1, and then mirrored back again for symmetry and windowed by the second half of the sine window, as described above. Such operation is to relieve the next frame from the burden of knowing whether this frame is lost. Basically, in a preferred embodiment, the method will prepare everything as if nothing had happened. What this means is that for the first 4 ms of the next frame (suppose it is not lost), the overlap-add operation between the extrapolated waveform and the real transmitted waveform will make the waveform transition from a lost frame to a good frame a smooth one.

Needless to say, the entire adaptive frame loss concealment operation is applicable to 16 kHz or 8 kHz output signal as well. The only differences are some parameter values related to the decimation factor. Experimentally it was determined that the same AFLC method works equally well at 16 KHz and 8 kHz.

D. Scalable and Embedded Codec Architecture

The description in Sections B and C above was made with reference to the basic codec architecture (i.e., without embedded coding) of illustrative embodiments of the present invention. As seen in Section C., the decoder used in accordance with the present invention has a very flexible architecture. This allows the normal decoding and adaptive frame loss concealment to be performed at the lower sampling rates of 16 kHz or 8 kHz without any change of the algorithm other than the change of a few parameter values, and without adding any complexity. In fact, as demonstrated above, the novel decoding method of the present invention results in substantial reduction in terms of complexity, compared with the prior art. This fact makes the basic codec architecture illustrated above amenable to scalable coding at different sampling rates, and further serves as a basis for an extended scalable and embedded codec architecture, used in a preferred embodiment of the present invention.

Generally, embedded coding in accordance with the present invention is based on the concept of using a simplified model of the signal with a small number of parameters, and gradually adding to the accuracy of each next stage of bit-rate to achieve a higher and higher fidelity in the reconstructed signal by adding new signal parameters, and/or increasing the accuracy of their representation. In the context of the discussion above, this implies that at lower bit-rates only the most significant transform coefficients (for audio signals usually those corresponding to the low-frequency band) are transmitted with a given number of bits. In the next-higher bit-rate stage, the original transform coefficients can be represented with a higher number of bits. Alternatively, more coefficients can be added, possibly using higher number of bits for their representation. Further extensions of the method of embedded coding would be apparent to persons of ordinary skill in the art. Scalability over different sampling rates has been described above and can further be appreciated with reference to the following examples.

To see how this extension to a scalable and embedded codec architecture can be accomplished, consider 4 possible bit rates of 16, 32, 48, and 64 kb/s, where 16 and 32 kb/s are used for transmission of signals sampled at 8 kHz sampling rate, and 48 and 64 kb/s are used for signals sampled at 16 and 32 kHz sampling rates, respectively. The input signal is assumed to have a sampling rate of 32 kHz. In a preferred embodiment, the encoder first encodes the information in the lowest 4 kHz of the spectral content (corresponding to 8 kHz sampling) to 16 kb/s. Then, it adds 16 kb/s more quantization resolution to the same spectral content to make the second bit rate of 32 kb/s. Thus, the 16 kb/s bit-stream is embedded in the 32 kb/s bit-stream. Similarly, the encoder adds another 16 kb/s to quantize the spectral content in the 0 to 8 kHz range to make a 48 kb/s, 16 kHz codec, and 16 kb/s more to quantize the spectral content in the 0 to 16 kHz range to make a 64 kb/s, 32 kHz codec.

At the lowest bit rate of 16 kb/s, the operations of blocks 10 and 20 shown in FIG. 1 would be the same as described above in Sections B.1 and B.2. The log-gain quantizer 30, however, would encode only the first 13 log-gains, which correspond to the frequency range of 0 to 4 kHz. The adaptive bit allocation block 40 then allocates the remaining bits in the 16 kb/s bit-stream to only the first 13 frequency bands. Blocks 50 through 80 of the encoder shown in FIG. 1 perform basically the same functions as before, except only on the MDCT coefficients in the first 13 frequency bands (0 to 4 kHz). Similarly, the corresponding 16 kb/s decoder performs essentially the same decoding functions, except only for the MDCT coefficients in the first 13 frequency bands and at an output sampling rate of 8 kHz.

To generate the next-highest bit rate of 32 kb/s, in accordance with the present invention, adaptive bit allocation block 40 assigns 16 kb/s, or 128 bits/frame, to the first 32 MDCT coefficients (0 to 4 kHz). However, before the bit allocation starts, the original TSNR value in each band used in the 16 kb/s codec should be reduced by 2 times the bits allocated to that band (i.e., 6 dB×number of bits). Block 40 then proceeds with usual bit allocation using such modified TSNR values. If an MDCT coefficient already received some bits in the 16 kb/s mode and now receives more bits, then a different quantizer designed for quantizing the MDCT coefficient quantization error of the 16 kb/s codec is used to quantize the MDCT coefficient quantization error of the 16 kb/s codec. The rest of the encoder operation is the same, as described above with reference to FIG. 1.

The corresponding 32 kb/s decoder decodes the first 16 kb/s bit-stream and the additional 16 kb/s bit-stream, adds the decoded MDCT coefficient of the 16 kb/s codec and the quantized version of the MDCT quantization error decoded from the additional 16 kb/s. This results in the final decoded MDCT coefficients for 0 to 4 kHz. The rest of the decoder operation is the same as in the 16 kb/s decoder.

Similarly, the 48 kb/s codec adds 16 kb/s, or 128 bits/frame by first spending some bits to quantize the 14th through the 18th log-gains (4 to 8 kHz), then the remaining bits are allocated by block 40 to MDCT coefficients based on 18 TSNR values. The last 5 of these 18 TSNR values are just directly mapped from quantized log-gains. Again, the first 13 TSNR values are reduced versions of the original TSNR values calculated at the 16 kb/s and 32 kb/s encoders. The reduction is again 2 times the total number of bits each frequency band receives in the first two codec stages (16 and 32 kb/s codecs). Block 40 then proceeds with bit allocation using such modified TSNR values. The rest of the encoder operates the same way as the 32 kb/s codec, except now it deals with the first 64 MDCT coefficients rather than the first 32. The corresponding decoder again operates similarly to the 32 kb/s decoder by adding additional quantized MDCT coefficients or adding additional resolution to the already quantized MDCT coefficients in the 0 to 4 kHz band. The rest of the decoding operations is essentially the same as described in Section C, except it now operates at 16 kHz.

The 64 kb/s codec operates almost the same way as the 48 kb/s codec, except that the 19th through the 23rd log-gains are quantized (rather than 14th through 18th), and of course everything else operates at the full 32 kHz sampling rate.

It should be apparent that straightforward extensions can be used to build the corresponding architecture for a scalable and embedded codec using alternative sampling rates and/or bit rates.

E. Examples

In an illustrative embodiment, an adaptive transform coding system and method is implemented in accordance with the principles of the present invention, where the sampling rate is chosen to be 32 kHz, and the codec output bit rate is 64 kb/s. Experimentally it was determined that for speech the codec output sounds essentially identical to the 32 kHz uncoded input (i.e., transparent quality) and is essentially indistinguishable from CD-quality speech. For music, the codec output was found to have near transparent quality.

In addition to high quality, the main emphasis and design criterion of this illustrative embodiment is low complexity and low delay. Normally for a given codec, if the input signal sampling rate is quadrupled from 8 kHz to 32 kHz, the codec complexity also quadruples, because there are four times as many samples per second to process. Using the principles of the present invention described above, the complexity of the illustrative embodiment is estimated to be less than 10 MIPS on a commercially available 16-bit fixed-point DSP chip. This complexity is lower than most of the low-bit-rate 8 kHz speech codecs, such as the G.723.1, G.729, and G.729A mentioned above, even though the codec's sampling rate is four times higher. In addition, the codec implemented in this embodiment has a frame size of 8 ms and a look ahead of 4 ms, for a total algorithmic buffering delay of 12 ms. Again, this delay is very low, and in particular is lower than the corresponding delays of the three popular G-series codecs above.

Another feature of the experimental embodiment of the present invention is that although the input signal has a sampling rate of 32 kHz, the decoder can decode the signal at one of three possible sampling rates: 32, 16, or 8 kHz. As explained above, the lower the output sampling rate, the lower the decoder complexity. Thus, the codec output can easily be transcoded to G.711 PCM at 8 kHz for further transmission through the PSTN, if necessary. Furthermore, the novel adaptive frame loss concealment described above, reduces significantly the distortion caused by a simulated (or actual) packet loss in the IP networks. All these features makes the current invention suitable for very high quality IP telephony or IP-based multimedia communications.

In another illustrative embodiment of the present invention, the codec is made scalable in both bit rate and sampling rate, with lower bit rate bit-streams embedded in higher bit rate bit-streams (i.e., embedded coding).

A particular embodiment of the present invention addresses the need to support multiple sampling rates and bit rates by being a scalable codec, which means that a single codec architecture can scale up or down easily to encode and decode speech or audio signals at a wide range of sampling rates (signal bandwidths) and bit-rates (transmission speed). This eliminates the disadvantages of implementing or running several different speech codecs on the same platform.

This embodiment of the present invention also has another important and desirable feature: embedded coding. This means that lower bit-rate output bit-streams are embedded in higher bit-rate bit-streams. As an example, in one illustrative embodiment of the present invention, the possible output bit-rates are 32, 48, and 64 kb/s; the 32 kb/s bit-stream is embedded in (i.e., is part of) the 48 kb/s bit-stream, which itself is embedded in the 64 kb/s bit-stream. A 32 kHz sampled speech or audio signal (with nearly 16 kHz bandwidth) can be encoded by such a scalable and embedded codec at 64 kb/s. The decoder can decode the full 64 kb/s bit-stream to produce CD or near-CD-quality output signal. The decoder can also be used to decode only the first 48 kb/s of the 64 kb/s bit-stream and produce a 16 kHz output signal, or it can decode only the first 32 kb/s portion of the bit-stream to produce toll-quality, telephone-bandwidth output signal at 8 kHz sampling rate. This embedded coding scheme allows this particular embodiment of the present invention to employ a single encoding operation to produce a 64 kb/s output bit-stream, rather than three separate encoding operations to produce the three separate bit-streams at the three different bit-rates. Furthermore, it allows the system to drop higher-order portions of the bit-stream (48 to 64 kb/s portion and the 32 to 48 kb/s portion) anywhere along the transmission path, and the decoder is still able to decode good quality output signal at lower bit-rates and sampling rates. This flexibility is very attractive from a system design point of view.

While the above description has been made with reference to preferred embodiments of the present invention, it should be clear that numerous modifications and extensions that are apparent to a person of ordinary skill in the art can be made without departing from the teachings of this invention and are intended to be within the scope of the following claims.

What is claimed is:

1. A system for processing audio signals comprising:

(a) a frame extractor for dividing an input audio signal into a plurality of signal frames corresponding to successive time intervals;

(b) a transform processor for performing transform computation of the input audio signal in at least one signal frame, said transform processor generating a transform signal having one or more (NB) bands;

(c) a quantizer providing quantized values associated with the transform signal in said NB bands;

(d) an output processor for forming an output bit stream corresponding to an encoded version of the input audio signal; and (e) a decoder capable of recontructing from the output bit stream at least two replicas of the input audio signal, each replica having a different sampling rate, without using downsampling.

2. The system of claim 1, further comprising an adaptive bit allocator for determining an optimum bit-allocation for encoding at least one of said NB bands of the transform signal.

3. The system of claim 2 further comprising a log-gain calculator for computing log-gain values corresponding to the base-2 logarithm of the average power of the coefficients in the NB bands of the transform signal.

4. The system of claim 3 wherein the bandwidth BW(i) of the i-th transform domain band is given by the expression $$BW(i)=BI(i+1)-BI(i)$$

where BI(i) is an array containing the indices of corresponding to the transform domain boundaries between bands, and the log-gains are calculated as $$LG(i) = \log_2\left(\frac{1}{NTPF \times BW(i)} \sum_{m=0}^{NTPF-1} \sum_{k=BI(i)}^{BI(i+1)-1} T^2(k, m)\right),$$

$$i = 0, 1, 2, \ldots, NB-1.$$

5. The system of claim 3 wherein said bit allocator warps possibly quantized log-gain values to target signal-to-noise ratio (TSNR) values in the base-2 log domain using a predefined warping function.

6. The system of claim 5, wherein said bit allocator allocates to the band with the largest TSNR value one bit for each transform coefficient in that band, and reduces the TSNR correspondingly, and repeats the operation until all available bits are exhausted.

7. The system of claim 3 wherein the output bit stream formed by the output processor further comprises quantized log-gain values for at least some of the NB bands of the transform signal.

8. The system of claim 1 wherein the decoder (e) is capable of identifying missing frames in the input signal.

9. The system of claim 8 wherein the decoder comprises an adaptive frame loss concealment processor operating to reduce the effect of missing frames on the quality of the output signal.

10. The system of claim 9 wherein the adaptive frame loss concealment processor computes an optimum time lag for waveform signal interpolation.

11. A method for processing audio signals, comprising:

dividing an input audio signal into frames corresponding to successive time intervals;

for each frame performing at least two relatively short-size transform computations;

extracting one set of side information about the frame from said at least two relatively short-size transform computations;

encoding information about the frame, said encoded information comprising the side information and transform coefficients from said at least two transform computations; and reconstructing the audio signal based on the encoded information.

12. The method of claim 11 using M transforms for each signal frame, said transforms performed over partially overlapping windows which cover the audio signal in a current frame and least one adjacent frame, wherein the overlapping portion is equal to 1/M of the frame size.

13. The method of claim 11 wherein a short-size transform is performed about every 4 ms.

14. The method of claim 11 wherein said at least two relatively short-size transforms are Modified Discrete Cosine Transforms (MDCTs).

15. The method of claim 11 wherein for each frame is computed a two-dimensional output transform coefficient array T(k,m) defined as:

$$T(k, m),\ k=0, 1, 2, \ldots, M-1, \text{ and } m=0, 1, \ldots, NTPF-1,$$

where M is the number of transform coefficients in each transform, and NTPF is the number of transforms per frame.

16. The method of claim 15 wherein each transform includes a DCT type IV transform computation, given by the expression:

$$X_k = \sqrt{\frac{2}{M}} \sum_{n=0}^{M-1} x_n \cos\left[\left(n+\frac{1}{2}\right)\left(k+\frac{1}{2}\right)\frac{\pi}{M}\right]$$

where $x_n$ is the time domain signal, $X_k$ is the DCT type IV transform of $x_n$, and M is the transform size.

17. The method of claim 11 wherein the size of the frame is selected relatively short to enable low algorithmic delay processing.

18. The method of claim 15 wherein transform coefficients T(k,m) obtained by each of said at least two transform computations are divided into NB frequency bands, and encoding information about each frame is done using the base-2 logarithm of the average power of the coefficients in the NB bands, said base-2 logarithm of the average power being defined as the log-gain.

19. The method of claim 18 wherein the bandwidth BW(i) of the i-th transform domain band is given by the expression $$BW(i)=BI(i+1)-BI(i).$$

where BI(i) is an array containing the indices of corresponding to the transform domain boundaries between bands, and the log-gains are calculated as $$LG(i) = \log_2\left(\frac{1}{NTPF \times BW(i)} \sum_{m=0}^{NTPF-1} \sum_{k=BI(i)}^{BI(i+1)-1} T^2(k, m)\right),$$

$$i = 0, 1, 2, \ldots, NB-1.$$

20. The method of claim 19 wherein bit allocation for the encoding of transform coefficients is performed based on the log-gains LG(i) in the NB bands.

21. The method of claim 20 wherein prior to bit allocation, the NB log-gains are mapped to a Target Signal to Noise Ratio (TSNR) scale using a warping curve.

22. The method of claim 21 wherein the warping curve is a piece-wise linear function.

23. The method of claim 21 wherein the band with the largest TSNR value is given one bit for each transform coefficient in that band and the TSNR is reduced correspondingly, and the bit allocation is repeated cyclically, until all available bits are exhausted.

24. The method of claim 21 wherein the number of bits assigned to each of the transform coefficients is based on the formula:

$$R_k = R + \frac{1}{2}\log_2 \frac{\sigma_k^2}{\left[\prod_{j=0}^{N-1} \sigma_j^2\right]^{1/N}}$$

where R is the average bit rate, N is the number of transform coefficients, $R_k$ is the bit rate for the k-th transform coefficient, and $\sigma_k^2$ is the square of the standard deviation of the k-th transform coefficient.

25. The method of claim 24 wherein the bit allocation formula is modified to:

$$R_k = R + \frac{1}{2}\left(lg\,(k) - \frac{1}{BI(NB)} \sum_{j=0}^{BI(NB)-1} lg(j)\right),$$

or $$R_k = R + \tfrac{1}{2}[lg(k) - \overline{lg}],$$

where lg(k)=LGQ(i), for k=BI(i),BI(i)+1, . . . , BI(i+1)−1, and LGQ(i) is the quantized log-gain in the i-th band; and $$\overline{lg} = \frac{1}{BI(NB)} \sum_{i=0}^{NB-1} [BI(i+1) - BI(i)]LGQ(i),$$

is the average quantized log-gain averaged over all frequency bands.

26. A method for adaptive frame loss concealment in processing of audio signals divided into frames corresponding to successive time intervals, where for each input frame one or more transform domain computations are performed over partially overlapping windows covering the audio signal, and output synthesis is performed using an overlap-and- add method, the method comprising:

in a sequence of received frames identifying a frame as missing;

analyzing the immediately preceding frame to determine an optimum time lag for waveform signal extrapolation;

based on the determined optimum time lag performing waveform signal extrapolation to synthesize a first portion of the missing frame, said synthesis using information already available as part of the preceding frame to minimize discontinuities at the frame boundary; and performing waveform signal extrapolation in the remaining portion of the missing frame.

27. The method of claim 26 wherein the step of analyzing is performed at least in part using a filtered and decimated version of the synthesis signal for the immediately preceding frame.

28. The method of claim 27 wherein the optimum time lag in the step of analyzing is identified using a peak of the cross-correlation function of the decimated version of the synthesis signal.

29. The method of claim 28 wherein the optimum time lag is further refined using the full version of the synthesis signal.

30. The method of claim 27 wherein the optimum time lag in the step of analyzing is identified as the time lag that minimizes discontinuities in the waveform sample from the preceding frame to the extrapolated current frame.

31. The method of claim 30 wherein a measure of discontinuities is computed in terms of both waveform sample values and waveform slope.

32. The method of claim 31 wherein the measure of discontinuities is computed using the decimated version of the synthesis signal for the immediately preceding frame and the extrapolated version of the decimated signal.

33. The method of claim 26 wherein the waveform extrapolation extends to the first portion of the frame immediately following the missing frame and further comprises windowing and overlap-and-add buffer update in preparation for the synthesis of the frame immediately following the missing frame.

34. A method for scalable processing of audio signals sampled at a first sampling rate and divided into frames corresponding to successive time intervals, where for each input frame one or more relatively short-size transform domain computations are performed over windows covering portions of the audio signal, comprising:

receiving transform domain coefficients corresponding to said one or more transform domain computations; and directly reconstructing the audio signal at a second sampling rate lower than the first sampling rate using an inverse transform operating only on a portion of the received transform domain coefficients, without downsampling.

35. The method of claim 34 wherein the one or more relatively short-size transform computations include Discrete Cosine transform (DCT) type IV computations, defined as:

$$X_k = \sqrt{\frac{2}{M}} \sum_{n=0}^{M-1} x_n \cos\left[\left(n + \frac{1}{2}\right)\left(k + \frac{1}{2}\right)\frac{\pi}{M}\right]$$

where $x_n$ is the time domain signal, $X_k$ is the DCT type IV transform of $x_n$, and M is the transform size, and the inverse DCT type IV is given by the expression:

$$x_n = \sqrt{\frac{2}{M}} \sum_{k=0}^{M-1} X_k \cos\left[\left(n + \frac{1}{2}\right)\left(k + \frac{1}{2}\right)\frac{\pi}{M}\right]$$

36. The method of claim 35, wherein the step of directly synthesizing at a ¼ sampling rate without downsampling comprises computing a (M/4)-point DCT type IV for the first quarter of the received DCT coefficients, as follows:

$$y_n = \sqrt{\frac{2}{(M/4)}} \sum_{k=0}^{\frac{M}{4}-1} X_k \cos\left[\left(n + \frac{1}{2}\right)\left(k + \frac{1}{2}\right)\frac{\pi}{(M/4)}\right]$$

where $$y_n = 2\left[\sqrt{\frac{2}{M}} \sum_{k=0}^{\frac{M}{4}-1} X_k \cos\left[\left(\left(4n + \frac{3}{2}\right) + \frac{1}{2}\right)\left(k + \frac{1}{2}\right)\frac{\pi}{M}\right]\right] = 2\tilde{x}_{4n+3/2}$$

so that $$\tilde{X}_{4n+3/2}\ \tfrac{1}{2}y_n$$

where:

$$\tilde{x}_n = \sqrt{\frac{2}{M}} \sum_{k=0}^{\frac{M}{4}-1} X_k \cos\left[\left(n+\frac{1}{2}\right)\left(k+\frac{1}{2}\right)\frac{\pi}{M}\right]$$

and using the above quantities in a DCT type IV inverse computation to obtain the reconstructed output signal having a ¼ sampling rate.

37. The method of claim 35, wherein the step of directly synthesizing at a ½ sampling rate without downsampling comprises computing a (M/2)-point DCT type IV for the first half of the received DCT coefficients, as follows:

$$y_n = \sqrt{\frac{2}{(M/2)}} \sum_{k=0}^{\frac{M}{2}-1} X_k \cos\left[\left(n+\frac{1}{2}\right)\left(k+\frac{1}{2}\right)\frac{\pi}{(M/2)}\right]$$

where $$y_n = \sqrt{(2)}\left[\sqrt{\frac{2}{M}} \sum_{k=0}^{\frac{M}{2}-1} X_k \cos\left[\left(\left(2n+\frac{1}{2}\right)+\frac{1}{2}\right)\left(k+\frac{1}{2}\right)\frac{\pi}{M}\right]\right]$$
$$= \sqrt{(2)}\,\tilde{x}_{2n+1/2}$$

so that $$\tilde{x}_{2n+1/2} = \frac{1}{\sqrt{(2)}} y_n$$

where:

$$\tilde{x}_n = \sqrt{\frac{2}{M}} \sum_{k=0}^{\frac{M}{2}-1} X_k \cos\left[\left(n+\frac{1}{2}\right)\left(k+\frac{1}{2}\right)\frac{\pi}{M}\right]$$

and using the above quantities in a DCT type IV inverse computation to obtain the reconstructed output signal having a ½ sampling rate.

38. A coding method for use in processing of audio signals divided into frames corresponding to successive time intervals, where for each input frame at least one transform domain computation is performed, and the transform coefficients are divided into NB bands, the method comprising:

computing a base-2 logarithm of the average power of the transform coefficients in the NB bands to obtain a log-gain array LG(i), i=0, . . . , NB−1;

encoding information about each frame based on the log-gain array LG(i), said encoded information comprising the transform coefficients, where the encoding step comprises:

computing a quantized log-gain array LGQ(i), i=0, . . . , NB−1; and converting the quantized log-gain coefficients of the array LGQ(i) into a linear-gain domain using the following steps:

(1) providing a table containing all possible values of the linear gain g(0) corresponding to the number of bits allocated to LGQ(0);

(2) finding the value of g(0) using table lookup;

(3) from the second band onward, applying the formula:

$$g(i)=2^{LGQ(i)/2}=2^{½[DLGQ(i)+LGQ(i-1)]}=2^{LGQ(i-1)/2}\times 2^{DLGQ(i)/2}=g(i-1)\times 2^{DLGQ(i)/2}$$

to compute recursively all linear gains using a single multiplication per linear gain, where each of the quantities $2^{DLGQ(i)/2}$ are found using table lookup; and decoding said encoded information about each frame to reconstruct the input audio signal.

39. The method of claim 38 wherein the step of encoding information further comprises encoding the values of the log-gain array LG(i).

40. An embedded coding method for use in processing of an audio signal divided into frames corresponding to successive time intervals, where for each input frame at least one transform domain computation is performed and the resulting transform coefficients are divided into NB bands, each band having at least one transform coefficient, the method comprising:

for a pre-specified first bit rate providing a first output bit stream which comprises information about transform coefficients in $M_1 \leqq NB$ bands and information about the average power in the $M_1$ bands, and wherein bit allocation is determined based on a target signal-to-noise ratio (TSNR) in the NB bands, said first output bit stream being sufficient to reconstruct a representation of the audio signal;

for at least a second pre-specified bit rate higher than the first bit rate, providing an output bit stream embedding said first output bit stream and further comprising information about transform coefficients in $M_2$ bands, where $M_1 \leqq M_2 \leqq NB$, and information about the average power in the $M_2$ bands, and wherein bit allocation is determined based on the difference between the TSNR in the NB bands and a value determined by the number of bits allocated to each band at the next-lower bit rate; and reconstructing a representation of the input signal using an embedded bit stream corresponding to the desired bit rate.

41. The method of claim 40 wherein the first output bit stream corresponds to a at a first bit rate;

for a given first bit rate, providing a bit allocation algorithm that takes into account band encoding information about each frame, said information comprising the transform coefficients, based on the gain array G(i); and decoding said encoded information about each frame to reconstruct the input audio signal.

42. A system for embedded coding of audio signals comprising:

a frame extractor for dividing an input audio signal into a plurality of signal frames corresponding to successive time intervals;

means for performing transform computation to provide transform-domain representation of the input audio signal in each frame, said transform-domain representation having n NB bands, where n>1;

means for providing a first encoded data stream corresponding to a user-specified portion of the transform-domain representation having m NB bands, where m<n, which first encoded data stream contains information sufficient to reconstruct a representation of the input audio signal;

means for providing one or more secondary encoded data streams comprising additional information to the user-specified portion of the transform-domain representation of the input audio signal; and means for providing an embedded output signal based at least on said first encoded data stream and said one or more secondary encoded data streams.

43. A method for processing audio signals, comprising:

dividing an input audio signal into frames corresponding to successive time intervals;

for each frame performing at least two relatively short-size transform computations to obtain a two-dimensional output transform coefficient array T(k,m) defined as:

$$T(k, m),\ k=0, 1, 2, \ldots, M-1, \text{ and } m=0, 1, \ldots, NTPF-1,$$

where M is the number of transform coefficients in each transform, and NTPF is the number of transforms per frame;

extracting one set of side information about the frame from said at least two relatively short-size transform computations;

encoding information about the frame, said encoded information comprising the side information and transform coefficients T(k, m) from said at least two transform computations wherein said transform coefficients being divided into NB frequency bands, and further wherein bit allocation is done by:

(a) constructing an approximation of the signal spectrum envelope using the log-gains of the coefficients in the NB bands;

(b) estimating a noise masking threshold function on the basis of the constructed approximation;

(c) mapping the signal-to-masking threshold ratio to target signal-to-noise (TSNR) values; and (d) performing bit allocation based on the mapping in (c); and reconstructing the audio signal based on the encoded information.

* * * * *